United States Patent [19]

Porta et al.

[11] 4,425,763

[45] Jan. 17, 1984

[54] COAL-FIRED STEAM LOCOMOTIVE

[75] Inventors: Livio D. Porta, Banfield, Argentina; David A. Berkowitz, Natick, Mass.; William L. Withuhn, Arlington, Va.; Carl C. Hamilton, Cuyahoga Falls, Ohio

[73] Assignee: American Coal Enterprises, Inc., Lebanon, N.J.

[21] Appl. No.: 185,601

[22] Filed: Sep. 9, 1980

[51] Int. Cl.[3] ..... B61B 1/12; B61B 9/28; F23B 1/10; F28B 7/00

[52] U.S. Cl. ..... 60/693; 60/670; 60/715; 105/37; 105/38; 105/43; 105/46; 105/234; 110/110; 110/198; 110/216; 414/175

[58] Field of Search ..... 60/653, 670, 677, 679, 60/693, 715; 105/36, 37, 38, 39, 48, 231, 238, 248, 253, 282 P, 43, 48.1, 46, 234; 110/113, 201, 212, 110, 198, 216; 236/14; 241/276; 410/68; 414/175

[56] References Cited

U.S. PATENT DOCUMENTS

| | | | |
|---|---|---|---|
| Re. 26,093 | 10/1966 | Ingram | 105/253 |
| 152,630 | 6/1874 | Haines | 410/68 |
| 298,086 | 5/1884 | Henry | 410/68 |
| 656,697 | 8/1900 | Mallet | 105/39 |
| 788,887 | 5/1905 | Collette | 105/237 |
| 1,531,202 | 3/1925 | Lösel | 60/715 |
| 1,570,106 | 1/1926 | Wagner | 105/37 X |
| 1,603,436 | 10/1926 | Whitelegg | 105/38 |
| 1,730,616 | 10/1929 | Lower et al. | 414/175 |
| 1,740,696 | 12/1929 | Ljungström et al. | 110/201 |
| 1,814,893 | 7/1931 | Burkhardt | 105/231 |
| 1,897,510 | 2/1933 | Roesch | 110/113 |
| 1,910,619 | 5/1933 | Lysholm et al. | 60/677 |
| 2,007,032 | 7/1935 | Wach | 60/715 |
| 2,036,907 | 4/1936 | Anderson | 241/276 |
| 2,072,292 | 3/1937 | Campbell | 105/282 P |
| 2,132,212 | 10/1938 | Johansson | 60/715 |
| 2,184,647 | 12/1939 | Lane | 236/14 |
| 2,274,395 | 2/1942 | Badenhausen | 105/36 |
| 2,306,148 | 12/1942 | Woodruff | 410/68 |
| 2,517,943 | 8/1950 | Townsend | 105/48 |
| 2,736,541 | 2/1956 | Maiman | 110/119 X |
| 2,857,854 | 10/1958 | Yellott | 105/35 |
| 2,879,717 | 3/1959 | Bailey et al. | 105/37 |
| 3,348,501 | 10/1967 | Stevens et al. | 105/248 |
| 3,423,933 | 1/1969 | Knizia | 60/653 |
| 3,552,332 | 1/1971 | Mattenley | 110/212 |
| 3,771,293 | 11/1973 | Vest | 105/59 X |
| 3,835,650 | 9/1974 | Chesmejef | 60/670 |
| 3,972,196 | 8/1976 | Silvestri, Jr. | 60/677 |
| 4,010,378 | 3/1977 | Tharpe et al. | 60/693 X |

FOREIGN PATENT DOCUMENTS

| | | | |
|---|---|---|---|
| 653188 | 11/1937 | Fed. Rep. of Germany | 105/37 |
| 1002020 | 2/1957 | Fed. Rep. of Germany | 105/48.1 |
| 587279 | 1/1925 | France | 105/40 |
| 85337 | 6/1981 | Switzerland | 105/47 |
| 389681 | 3/1933 | United Kingdom | 105/37 |
| 812154 | 4/1959 | United Kingdom | 105/46 |

OTHER PUBLICATIONS

Porta, "Steam Locomotive Development in Argentina", Journal of the Institute of Locomotive Engineers, Mar. 1969, pp. 205–256.

Hamilton et al., "Coal-Fired Steam-Turbine-Electric Locomotive", Mechanical Engineer, Jul. 1955, pp. 588–595.

Withuhn, "Did We Scrap Steam Too Soon?", Trains, Jun. 1974, pp. 36–48.

"Weer stoomtractie door olieschaarste?" Modelbouwer, Jul. 1978, pp. 280–281.

*Primary Examiner*—Robert B. Reeves
*Assistant Examiner*—Howard Beltran
*Attorney, Agent, or Firm*—Fleit, Jacobson, Cohn & Price

[57] ABSTRACT

A coal-fired steam locomotive powered by reciprocating steam engines. The locomotive is a two-unit drawbar-coupled locomotive. The units, which are designated as a power unit and a support unit, are arranged back-to-back, with each having a cab-in-front. Operation of the locomotive is equally effective in both directions. The power unit basically contains a furnace and combustion system, an ash storage system, a gas cleanup and exhaust system, a boiler and steam generator, steam engines, a jet condenser, and a control cab. The support unit, on two 6-wheel trucks, contains a modular coal storage area, a stoker motor, a water storage area, heat transfer assemblies and fans for air-cooling circulating water, and a second control cab. The coal-gasification furnace, steam boiler, and steam engines are all in a closed system. Further, the steam engines of the locomotive are in the form of a four cylinder, balanced system for driving the running gear of the locomotive. The steam expansion cycle is compounded; two high pressure cylinders exhaust into two low pressure cylinders, with all cylinders sized for equal thrust. Spent steam is condensed, cooled on-board, and the water recycled through the boiler. A condensing cycle is utilized to both obtain more power and minimize water make up. A large water supply is carried on the support unit to minimize way side water points. Condensing of the water is by jet condensing which takes place on the power unit and utilizes feedwater as the jet condensing means. The heated water is pumped through a heat exchanger provided on the support unit before returning to the water supply tank. In order to eliminate nusiance dirt, coal is prepackaged in large modules. Up to three modules are placed over the stoker screw mechanism contained on the support unit.

27 Claims, 42 Drawing Figures

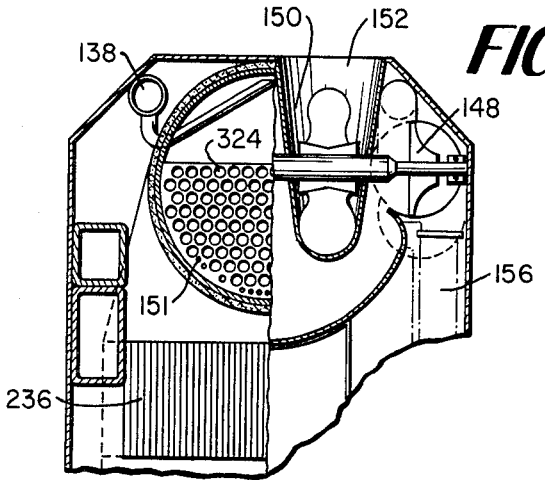
FIG. 15
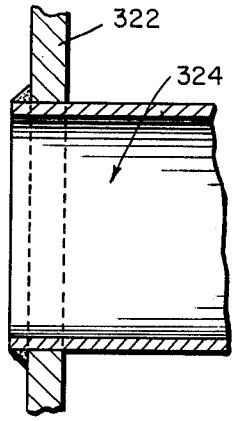
FIG. 16
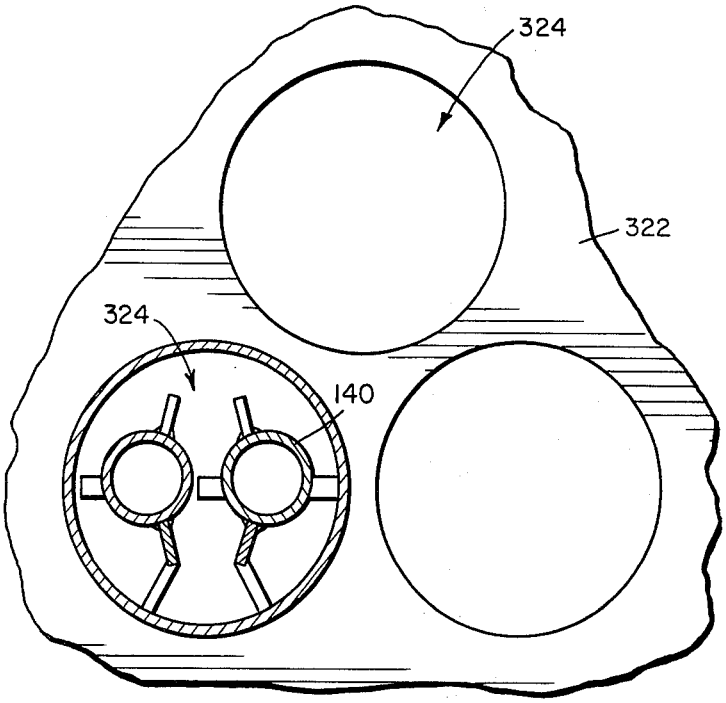
FIG. 17
FIG. 18
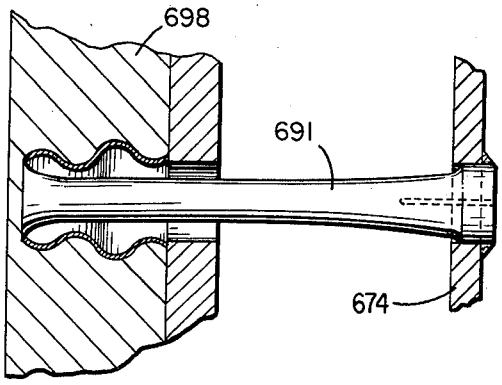

FIG. 23a
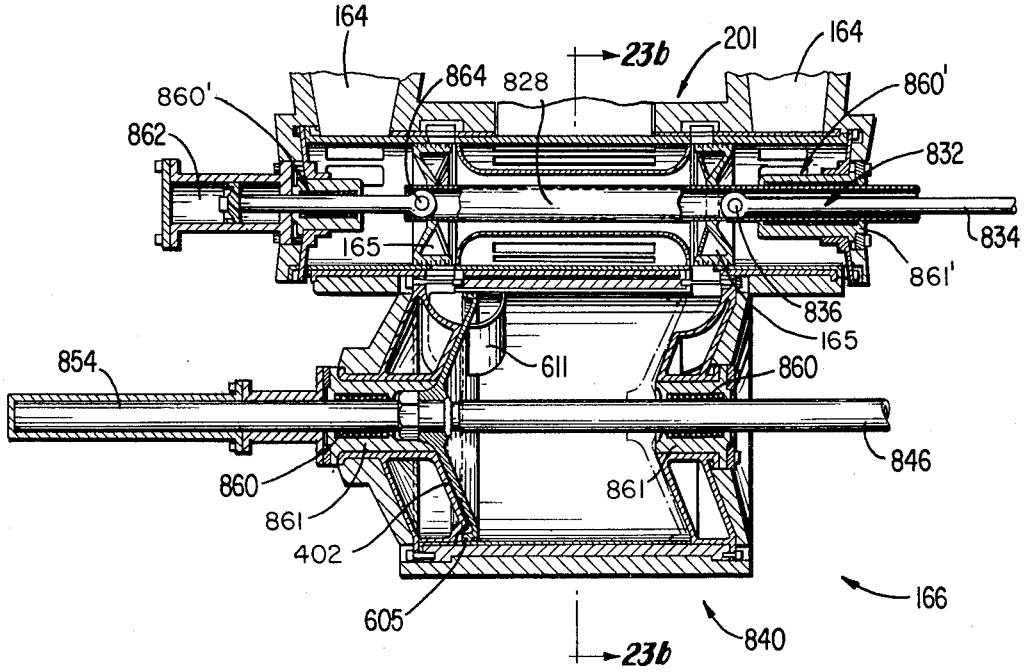
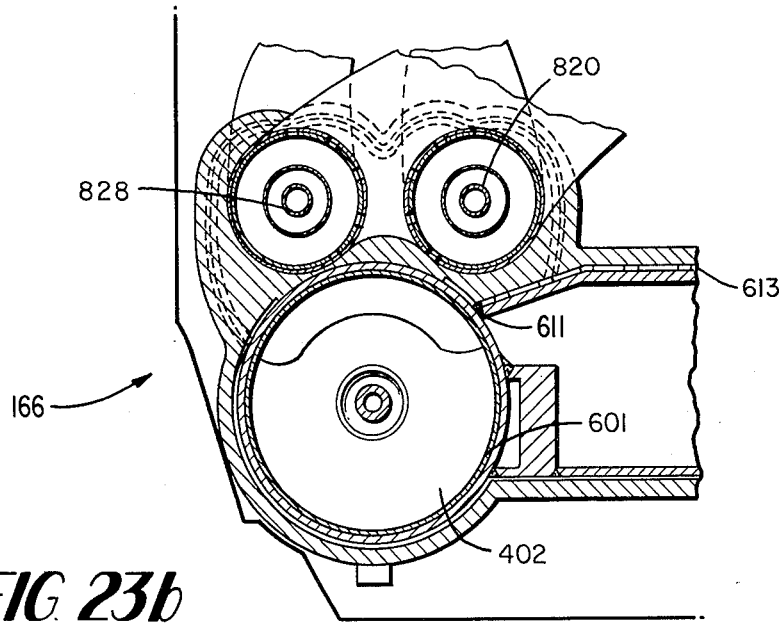
FIG. 23b

FIG. 28
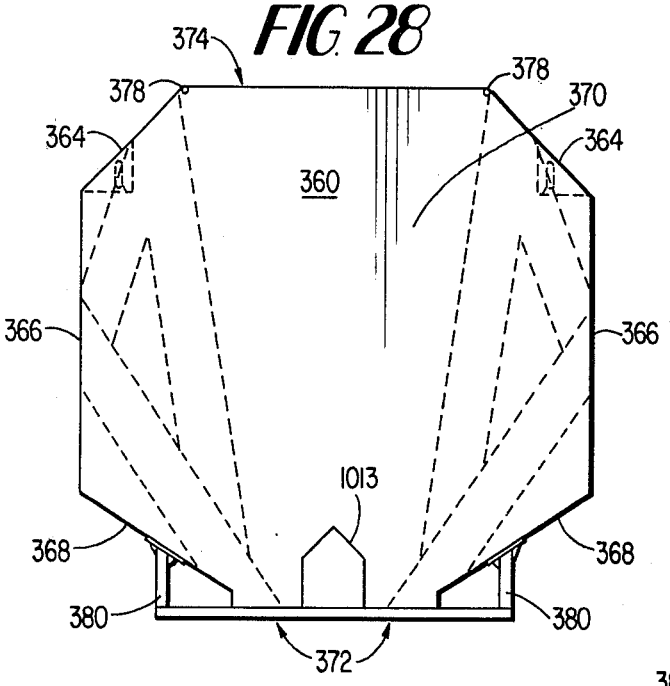
FIG. 29
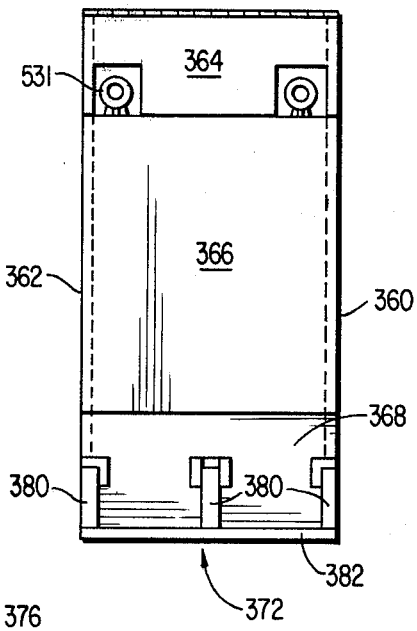
FIG. 30
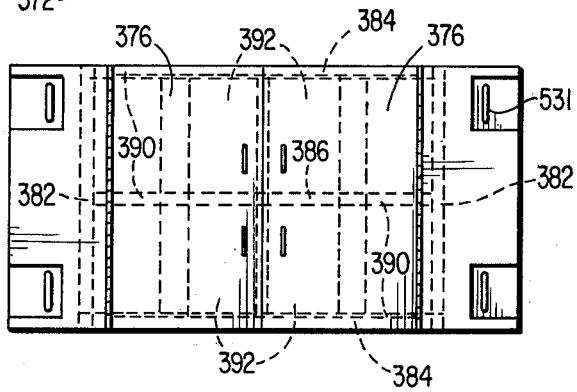
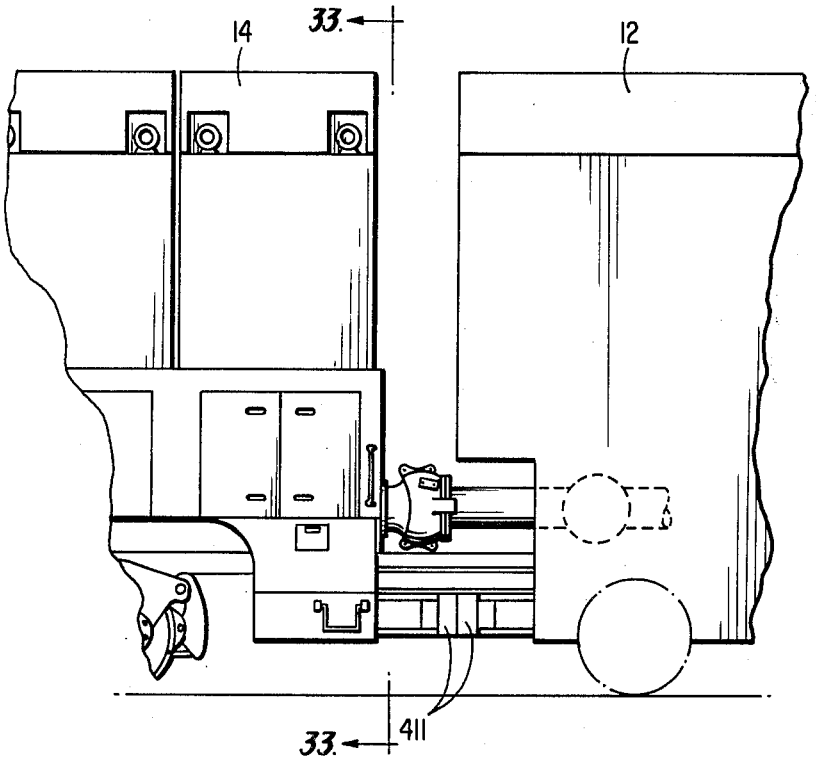
FIG. 31

FIG. 32
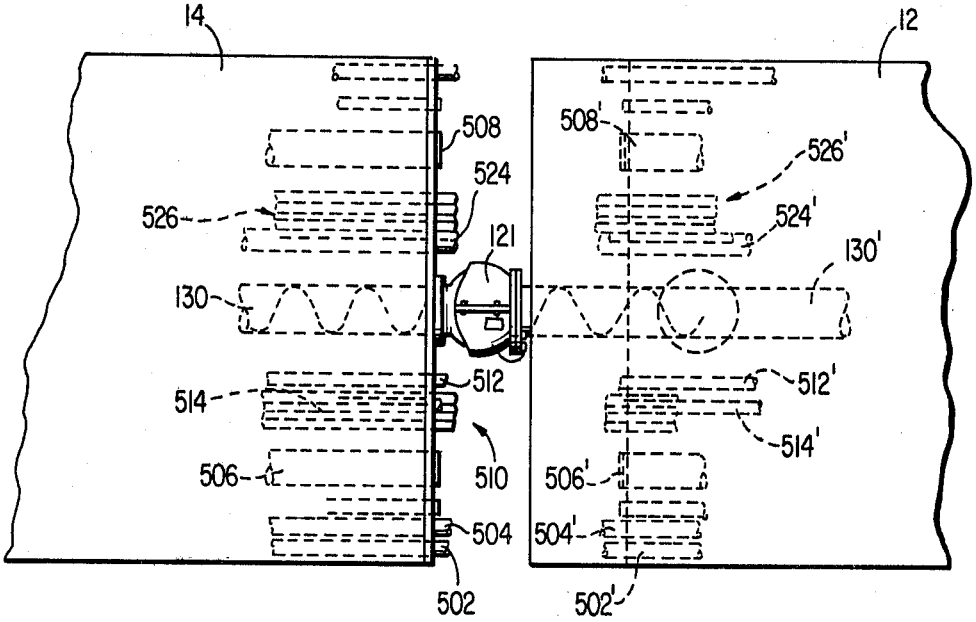
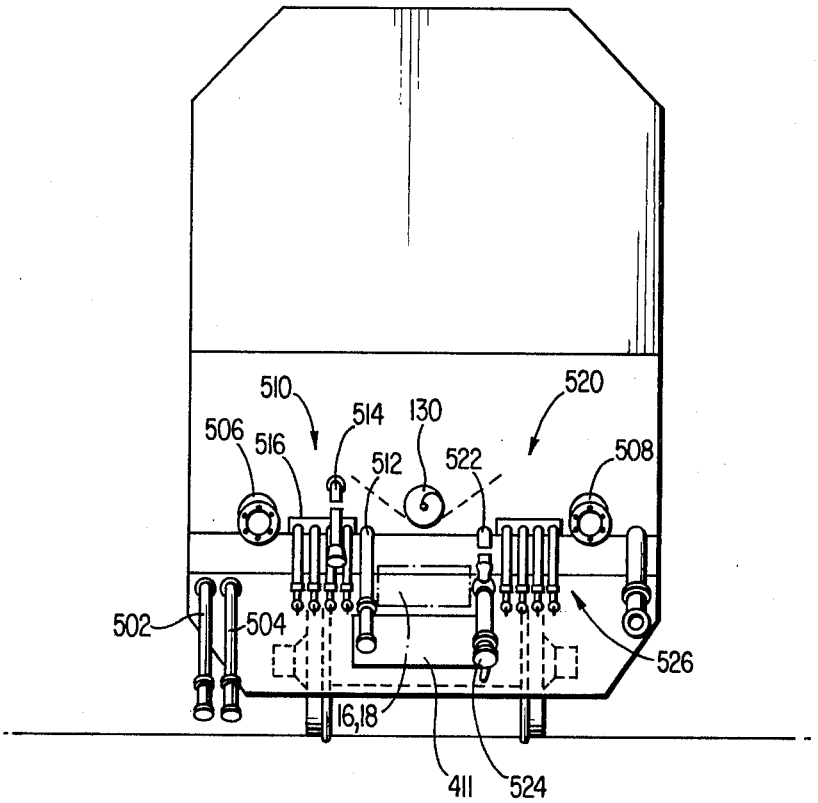
FIG. 33

COAL-FIRED STEAM LOCOMOTIVE

BACKGROUND OF THE INVENTION

1. Field of the Invention

This invention relates to improvements in locomotives and is more particularly concerned with the locomotive which burns coal efficiently and cleanly, and which is compatible with current railroad operating practice.

2. Background of the Prior Art

As a result of the successful introduction of diesel locomotives, the development of coal-fired steam locomotives ceased in the United States in the 1950s. However, steam technology continued to advance in this country and elsewhere, particularly in electric utilities. In a few countries, new designs of railroad steam power in the 1940s and 50s achieved useful fuel efficiencies as high as 12 percent, a level substantially greater than the five to seven percent characteristic of the last U.S. steam locomotives built in any large numbers.

Besides technological advances, other circumstances have changed since the end of steam power on U.S. railroads. Environmental factors such as pollution and noise are now stringently regulated. Railroad operating requirements have changed, and fuel oil prices have increased dramatically.

The basis of most steam locomotives is a noncondensing steam engine of two or more cylinders. In the simpler types of locomotive the cylinders operate with steam at boiler pressure, but in the larger types, the cylinders are often compounded, using the exhaust steam from a set of high-pressure cylinders to power a set of low-pressure cylinders. Steam for the cylinders is provided by a horizontal boiler of the fire-tube type, and the boiler is heated by a firebox or furnace in which coal or fuel oil is burned. After leaving the boiler, the steam is superheated to lessen condensation in the cylinders.

In most U.S. locomotives, steam is admitted to and exhausted from the cylinders by means of slide or piston valves mounted on top of the cylinders. The valves are operated by means of a valve gear which is driven by an eccentric from the driving wheels. Provision is made for the engineer to alter the timing of the valves while the locomotive is in motion to obtain maximum efficiency and maximum power. Some European steam locomotives employ poppet valves instead of slide valves.

The pistons of the cylinders are coupled to the main driving wheel by means of a connecting rod which is fitted to a crank pin on the wheel, and the other drivers are connected to the main wheel by side rods and crankpins. In many cases engines are provided with an additional set of cylinders which operate on the trailing truck of the engine and which are used as "boosters" to give additional power for starting.

On prior locomotives, an enclosed cab is provided at the rear of the engine, behind the boiler and firebox. In this cab all the instruments and controls of the engine are mounted, and at either side are seats for the engineer and fireman. The seats are offset and are provided with windows to give a clear view ahead. The engineer's seat is to the right, and the important controls—throttle, valve-setting controls, and brakes—are grouped on that side of the cab. In smaller locomotives the furnace is hand-fired by the fireman through a fire door in the cab. In large locomotives, the amount of coal used is too great to permit manual firing, and automatic stokers are provided to feed coal to the firebox. In such locomotives the fireman's duties are confined to spreading the coal on the surface of the fire and seeing that the fire burns evenly.

The coal or other fuel used by the engine is carried in a separate tender which is permanently coupled to the rear of the engine behind the cab. The tender carries not only fuel but also water to replace the steam expended in driving the locomotive. In some locomotives the tender is fitted with auxiliary cylinders and acts as a starting booster.

Steam locomotives vary widely in size, power, and design, depending on the uses to which they are put, such as switching, fast passenger runs, or heavy freight hauling. A typical freight locomotive of the steam era had a total weight of 200 tons, of which 130 tons were supported on the driving wheels. Its cylinders had a bore of 25 in. and a stroke of 34 in. Boiler pressure was 245 lb. per sq. in., and the maximum drawbar pull was 64,000 lb. Drawbar pull is the measure of a locomotive's power. A drawbar pull of 1 lb. is, on the average, sufficient to haul a load of 285 lb. on straight, level track. The power required for starting the train is much greater than that needed to pull a moving train. About 1 lb. of drawbar pull is necessary to start a load of 110 lb.

The overall efficiency of a prior art reciprocating steam locomotive was never more than about 8 percent and averaged about 5 percent. Various losses occurred through heat and friction loss of carbon, and an appreciable amount of the steam generated in the boiler was used to operate various auxiliary devices with which most locomotives were equipped. These included pumps for the train's air-brake system, generators, feedwater pumps, rail sanders, stoking devices, and many others.

Beginning about 1940, several U.S. railroads built experimental locomotives powered with steam turbines. In most of these locomotives the turbine was geared down to operate an electric generator which supplied power to driving motors, but in at least one engine, direct drive was used and the turbine was geared to the driving wheels. Operation of these locomotives showed a thermal efficiency greater than that of conventional steam locomotives, but not so high as that of Diesel-electrics.

There is thus a need for an environmentally safe coal-fired, steam locomotive in which heat losses are minimized to improve the overall efficiency of the locomotive, thus providing a viable economic alternative to present day electric and diesel systems. There is also a need for a locomotive which, through employment of modular fabrication techniques, is easily and economically manufactured and serviced. The present invention is directed towards filling those needs.

SUMMARY OF THE INVENTION

The present invention relates to a coal-fired steam locomotive powered by reciprocating steam engines. Its design reflects primary concern for environmental protection and fuel resource conservation. It is a general purpose locomotive, fully compatible with current railroad operating and maintenance practice.

The locomotive is a two-unit, drawbar-coupled locomotive. The units, which are designated as a power unit and a support unit, are arranged back-to-back, with each having a cab-in-front. Operation of the locomotive is equally effective in both directions.

The power unit basically contains a combustion system, an ash storage system, a gas cleanup and exhaust system, a steam generator, a steam engine, an eductor or jet condenser, and a control cab.

In a preferred embodiment, wheel arrangement is 4-8-2, with the leading 4-wheel engine truck providing vehicle guidance when the power unit is in front. Numbers 1 and 4 driven axles have lateral freedom with spring restoration for normal operation on track up to 20-degrees of curvature.

The support unit, on two 6-wheel trucks, contains a coal storage area, a stoker motor, a water storage area, heat transfer assemblies and fans for air-cooling circulating water, and a second control cab.

According to the teachings of the present invention, the steam engine of the locomotive is in the form of a four cylinder, balanced system for driving the running gear of the locomotive.

In a preferred embodiment, the furnace or combustion chamber is arranged in a two stage configuration. Coal is supplied to the primary combustion stage with a stoker screw and spreading means, such as mechanical flippers and/or steam or air jets, to evenly cover the burning fuel bed. Heated air and steam, produced in the steam boiler, are introduced under the grate contained in the lower combustion space, in proper proportion to gasify the coal.

As the gases rise above the fuel bed of the moving or shuffling grate, they are supplied with additional air to sustain ignition and complete combustion. This secondary air is supplied multicyclonically in order to obtain intimate mixing and a longer flame travel. The ashes produced during combustion discharge continuously by shuffling action of the grate to an ash pan separately located on the power unit. The gases produced during combustion leave the fuel bed and secondary combustion space through an opening in the furnace arch and are introduced into an upper chamber, which is located above the furnace arch. Combustion is completed in the upper chamber before the hot flue gas enters a fire tube convection section.

The firetube convection section contains a number of firetubes which may be a smooth wall of thin inner surface to obtain a more efficient heat transfer to water. In a preferred embodiment, a superheater is additionally fitted within the fire tubes for heat transfer to steam. Following the superheater area, the flue gas is conducted into a rectangular chamber of flue gas plenum, across a sinus tube economizer, and into a multi-cyclone dust collector. The clean gas then enters a turbine driven induced draft (ID) fan for exhaust to atmosphere.

Water is stored in the support unit storage tank, and delivered by gravity to a booster injector to provide positive suction head, and then to a boiler feedwater pump. The feed pump is driven directly from an exhaust steam turbine shaft; pump speed is self-regulated in proportion to steam flow. A flow control valve downstream of the pump provides feedwater trim control. Boiler feed is pressure delivered to a feedwater heater (heated by extraction steam from the high pressure cylinder), then to the economizer and to the boiler water space as required to maintain the proper water level.

Steam from the boiler is collected in a dry tube and delivered to the superheater header. Each superheater tube has two loops in series, one in each of two firetubes. Steam is returned to the superheater outlet header, then flows through the induced draft (ID) fan turbine, then through throttle valves before entering the high pressure engine valve chest of each of two high pressure cylinders. A Weiss port in each of the high pressure cylinders supplies extraction steam to the feedwater heater and combustion air preheater. Most of the high pressure steam passes through the piston valves from the valve chest into the high pressure cylinders where it acts on the pistons, thus, converting the thermal energy of the steam into useful work which drives the locomotive. Steam exhausting from each of the high pressure cylinders passes through a receiver pipe, and then into a low pressure engine valve chest of one of two low pressure cylinders, one being associated with each of the receiver pipes. A Weiss port in each of the low pressure cylinders supplies extraction steam for undergrate steam injection and combustion air preheating. Extraction steam condensate from both air preheaters and feedwater heater is returned to the water tank through injectors. Most of the low pressure steam passes through the piston valves into the low pressure cylinders where it acts on the pistons which drive the locomotive.

Steam exhausting from the low pressure cylinders passes through a pair of low pressure exhaust turbines on a common shaft and into a pair of eductor condensers where steam is condensed to water by intermingling with recycled tank water. The water jet into the eductor condensers is propelled by a first water circulation pump, which is driven directly from the exhaust turbine shaft. A second water circulation pump, which is also driven directly from the exhaust turbine shaft, draws suction from the eductor condensers and delivers high pressure water to the support unit to power water turbines for driving cooling fans and the coal feed screw. All water delivered by the second water circulation pump is finally discharged into heat exchangers as cooling coils transferring heat from the water to ambient air, and then drained back into the water tank.

A condensing cycle is utilized to both obtain more power and minimize water make up. A large water supply is carried on the support unit to minimize way side watering points.

In order to eliminate fugitive dust, coal is prepackaged in large modules. Up to three modules are placed over the stoker screw mechanism contained on the support unit.

Power from the high and low pressure cylinders is applied to four driven axles through a mechanical transmission. Cylinders are arranged in two opposed pairs, and are mechanically coupled through the mechanical transmission such that reciprocating mass is fully balanced. This arrangement permits full rotational balance of all driven axles, as well. Thus, all unsprung weight in the wheels and the connecting rods is dynamically balanced. As a result, rail-vehicle interactions should be smooth and weight of the locomotive is equalized among all locomotive axles.

The steam expansion cycle is compounded; two high pressure cylinders exhaust into two low pressure cylinders, with all cylinders sized for equal thrust. Spent steam is condensed, cooled on-board, and the water recycled through the boiler. Steam and water flow paths have been designed to minimize pressure drops in pipes and frictional losses at bends, corners, and valve openings, in order to improve overall efficiency.

It is thus a primary object of the present invention to provide a locomotive which employs an efficient reliable power source.

It is another object of the present invention to provide a locomotive having a closed cycle steam condensing system.

It is a further object of the present invention to provide a locomotive having a coal furnace of improved performance characteristics.

It is still an object of the present invention to provide a locomotive having a dedicated power unit and a dedicated support unit.

It is yet an object of the present invention to provide a locomotive of modular construction.

It is still another object of the present invention to provide a locomotive employing pre-packaged fuel modules.

It is yet another object of the present invention to provide a locomotive employing modular packages for receiving the products of combustion and the other waste products associated with the operation of the locomotive.

It is still a further object of the present invention to provide a locomotive employing an improved steam engine which includes an improved drive system.

It is yet a further object of the present invention to provide a locomotive which is more economically sound then has heretobefore been possible.

These and other objects will become apparent from the following drawings and detailed description.

BRIEF DESCRIPTIONS OF THE DRAWINGS

Figure 2:
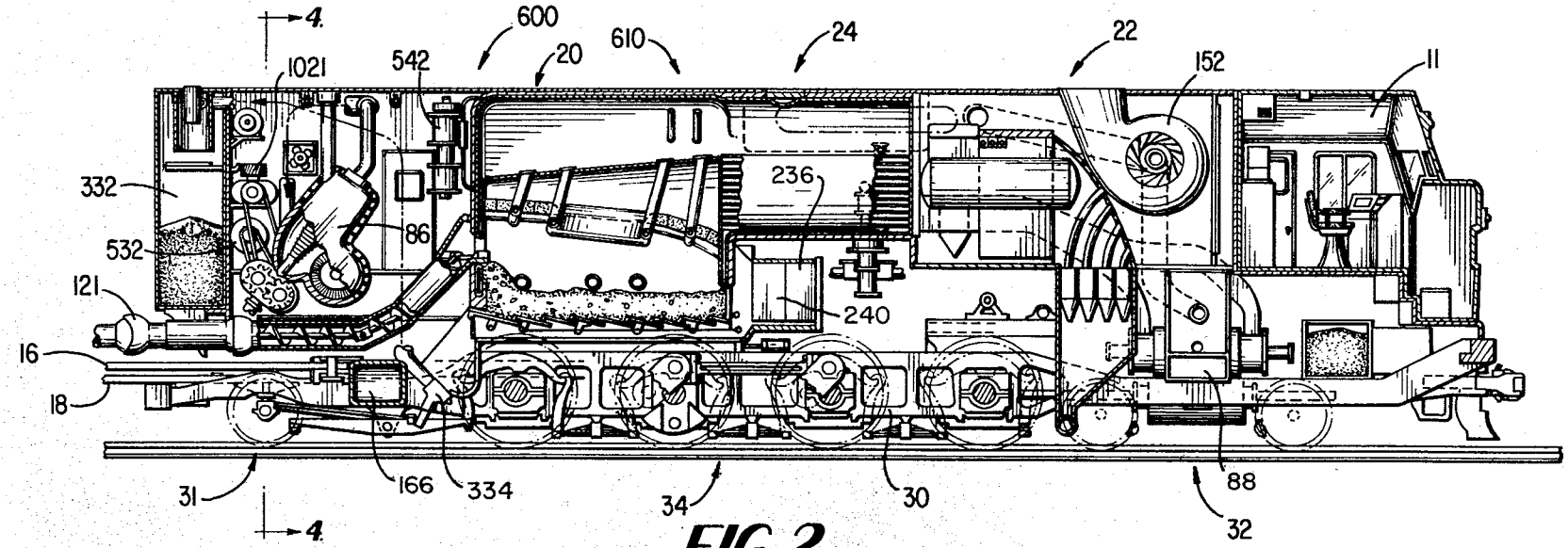
FIG. 2 is a predominantly side elevation of the power unit of FIG. 1 with the side covering removed.
Figure 2A:
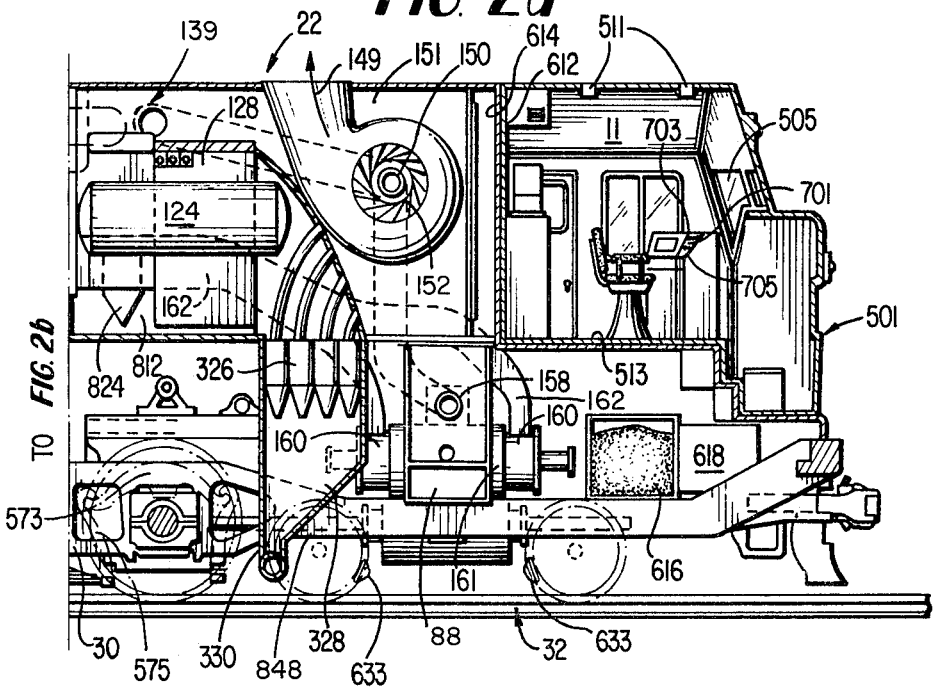

FIGS *2a* and *2b*, together, constitute our enlarged view of FIG. 2.

Figure 3:
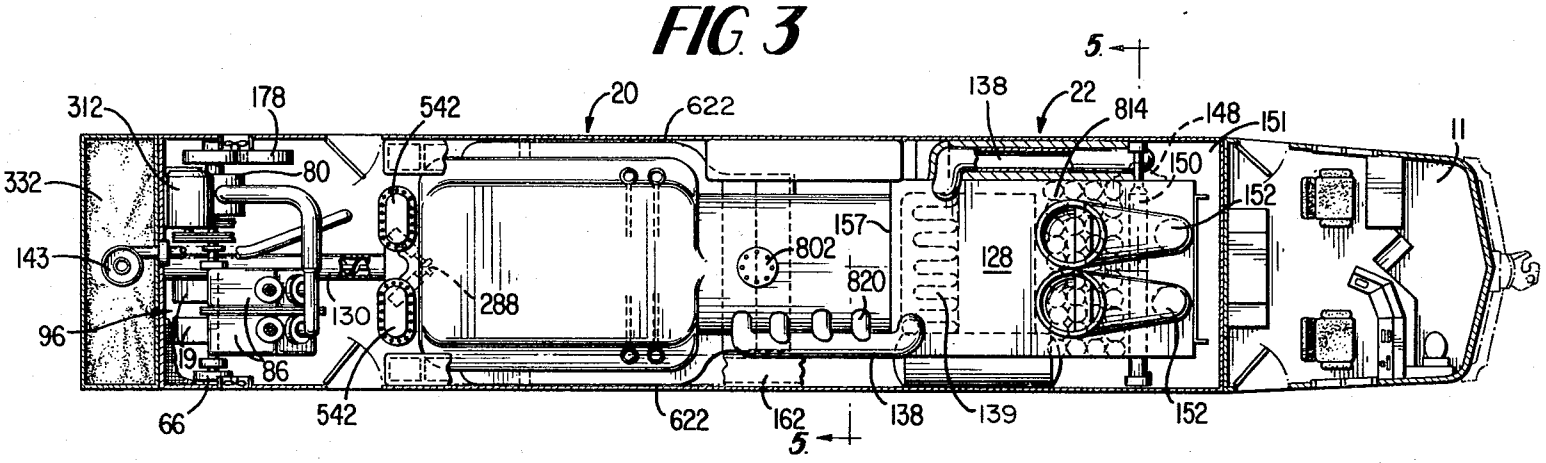

FIG. 3 is a top plan view of the power unit of FIG. 2 with the top covering removed.

Figure 4:
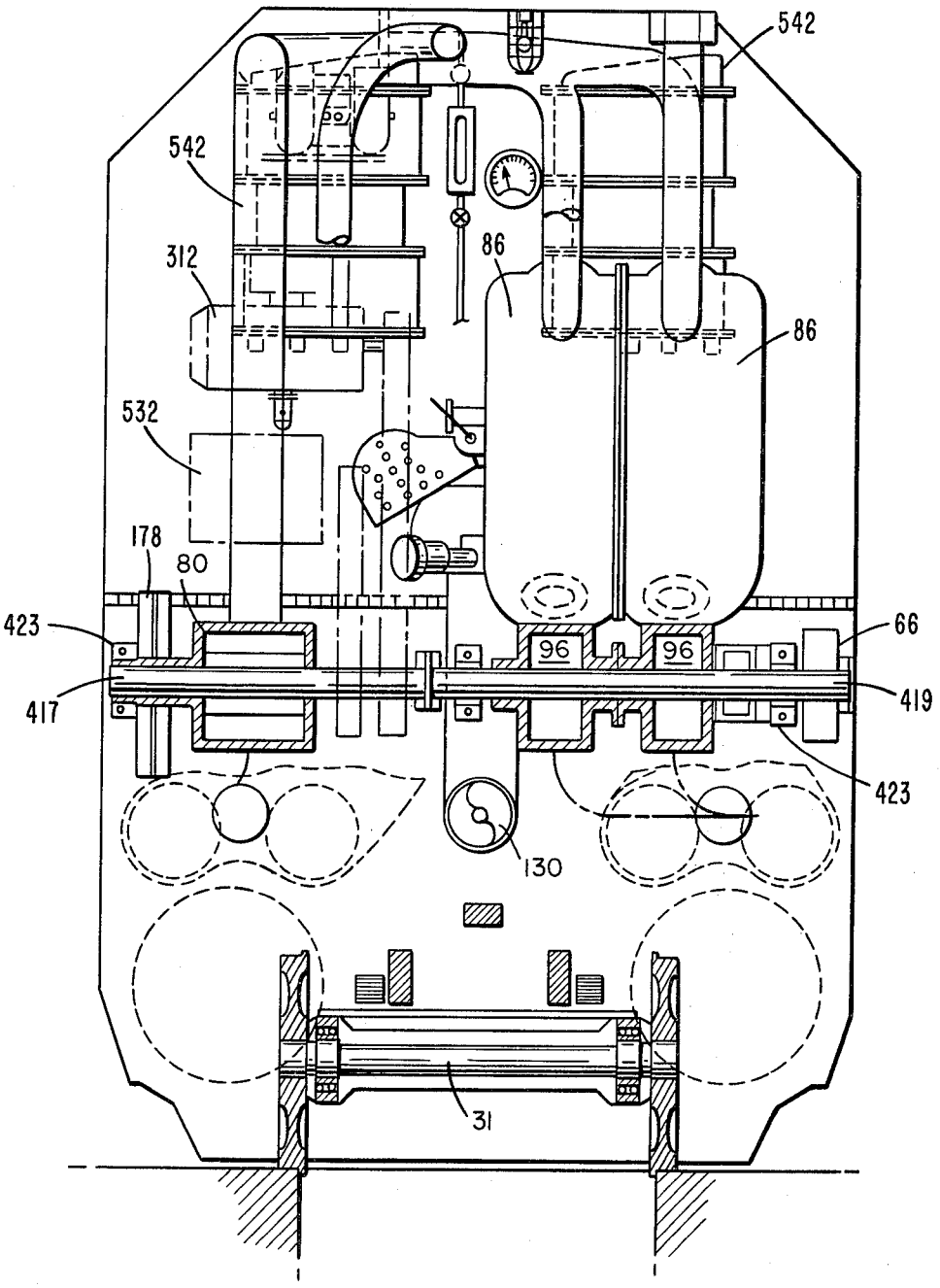

FIG. 4 is a section taken along lines 4—4 of FIG. 2.

Figure 5:
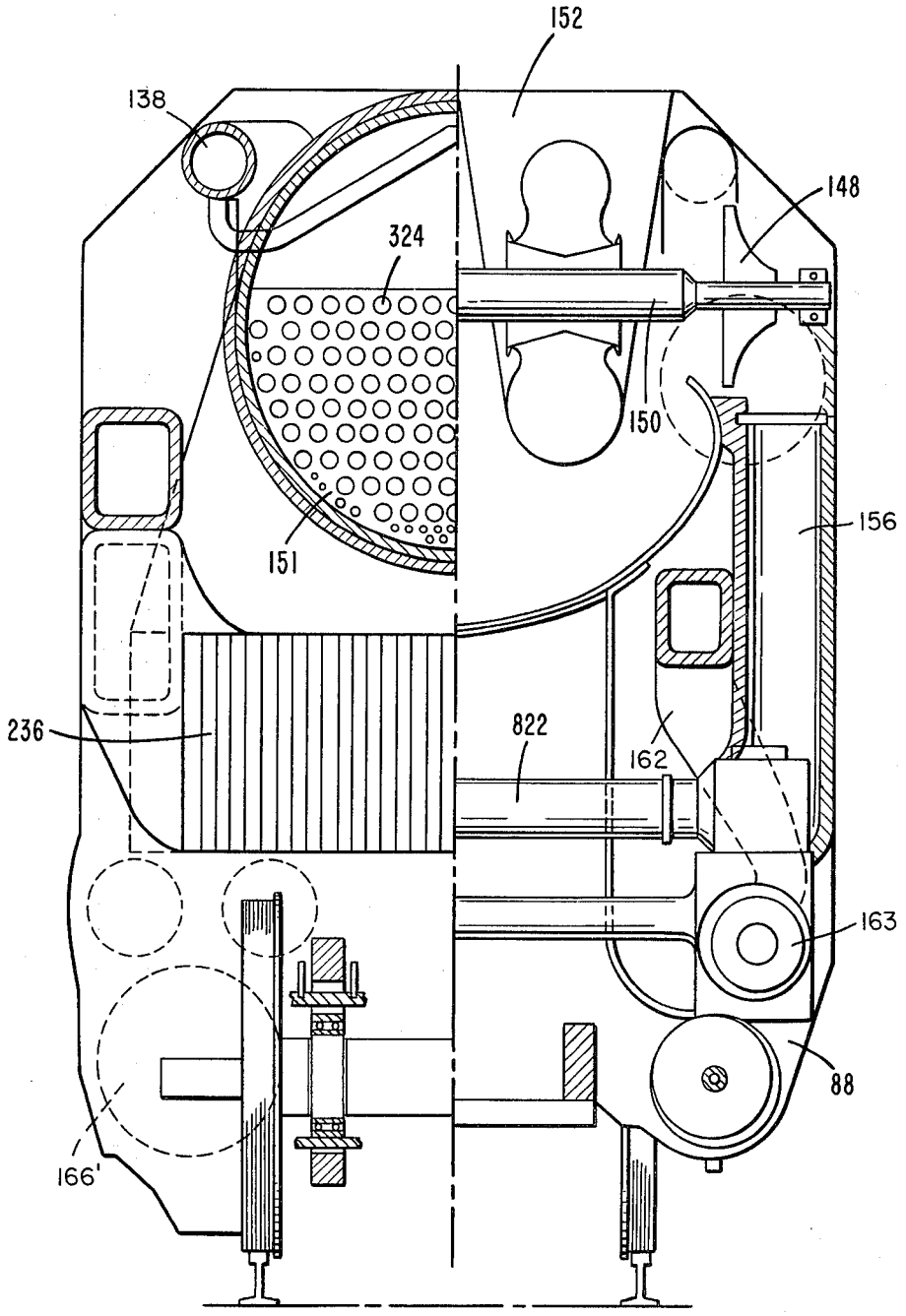

FIG. 5 is a section taken along lines 5—5 of FIG. 3.

Figure 6:
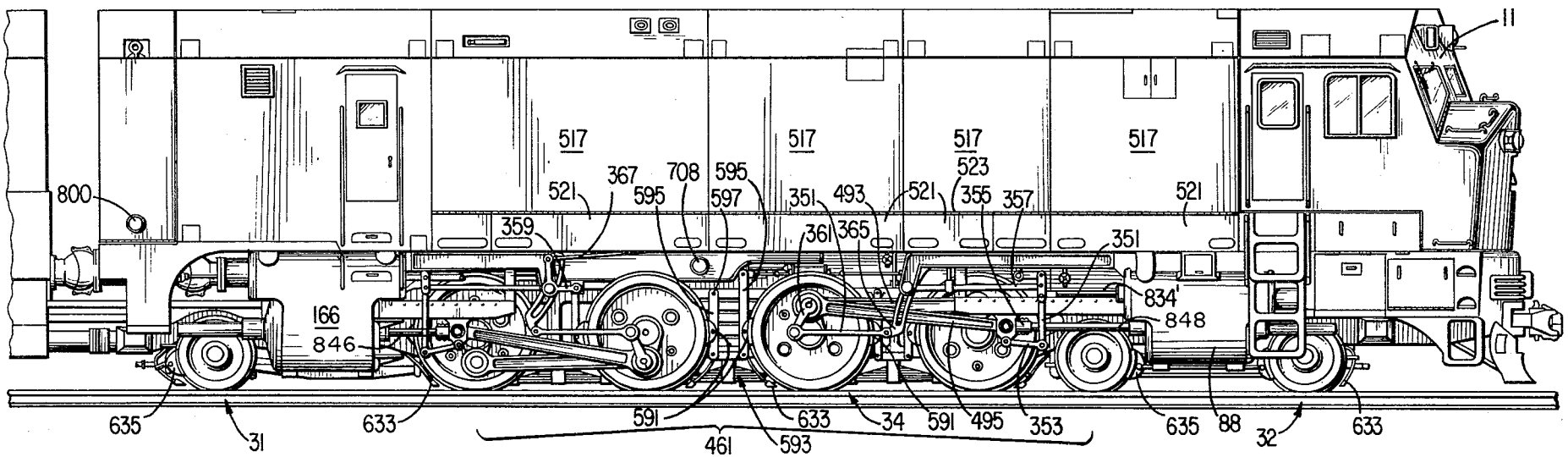

FIG. 6 is a side elevation of the power unit of FIG. 2.

Figure 7:
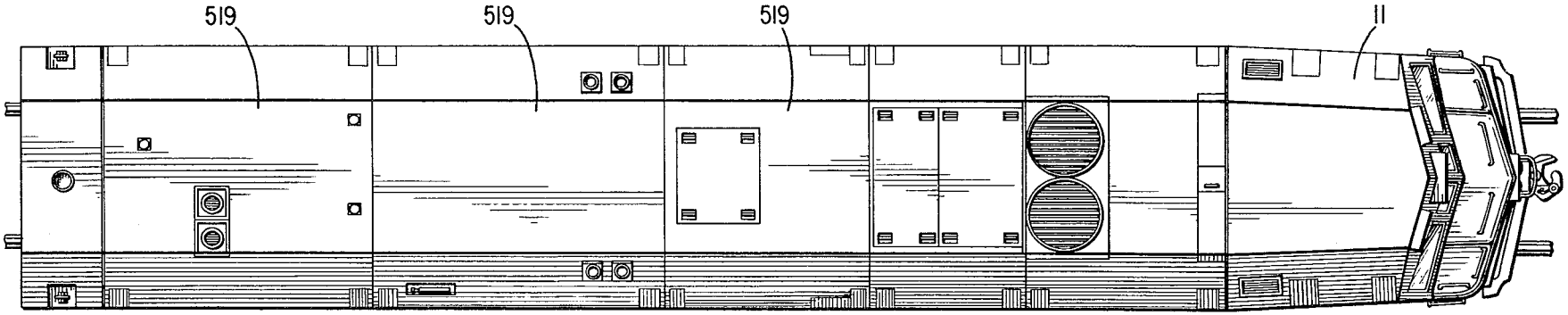

FIG. 7 is a top plan view of the power unit of FIG. 6.

Figure 1:
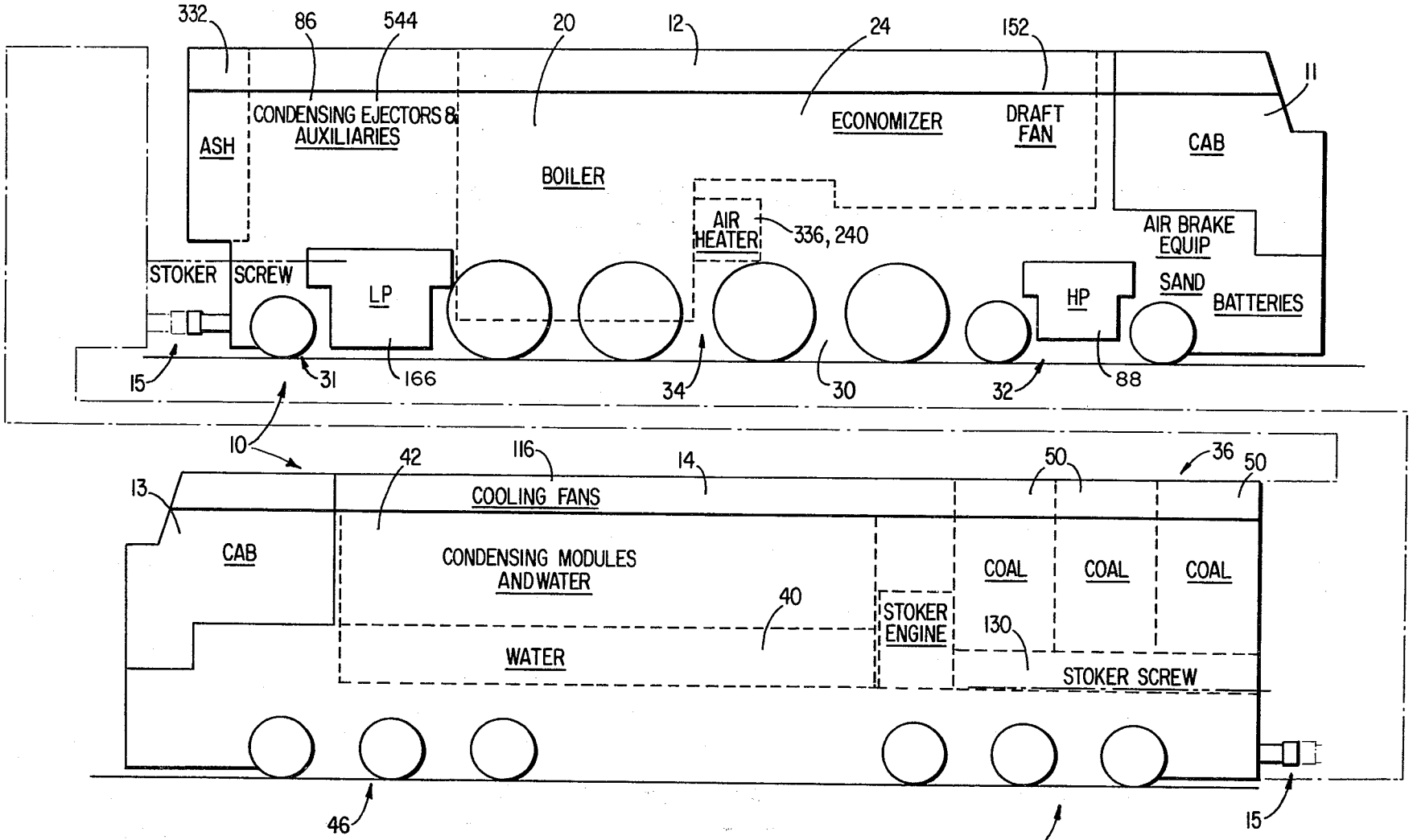
FIG. 1 is a schematic illustration of a preferred embodiment of a locomotive according to the teachings of the present invention showing a support unit and a power unit.
Figure 8:
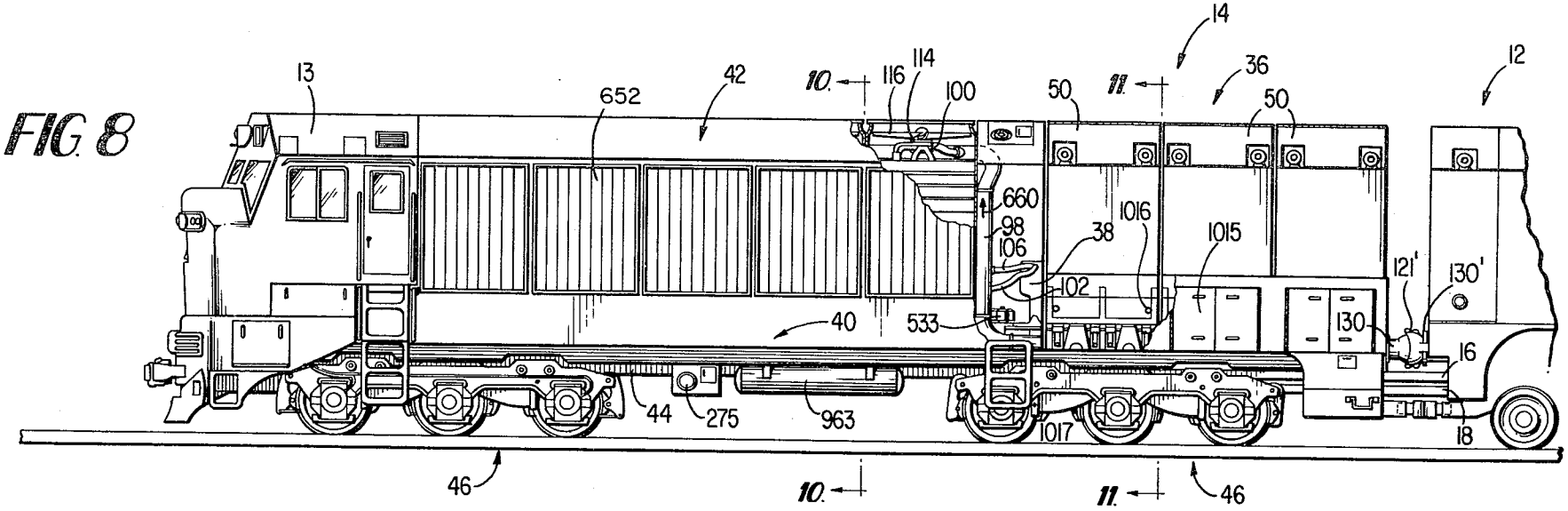

FIG. 8 is a side elevation, partially cut away, of the support unit of FIG. 1 with a portion of the power unit of FIG. 1.

Figure 9:
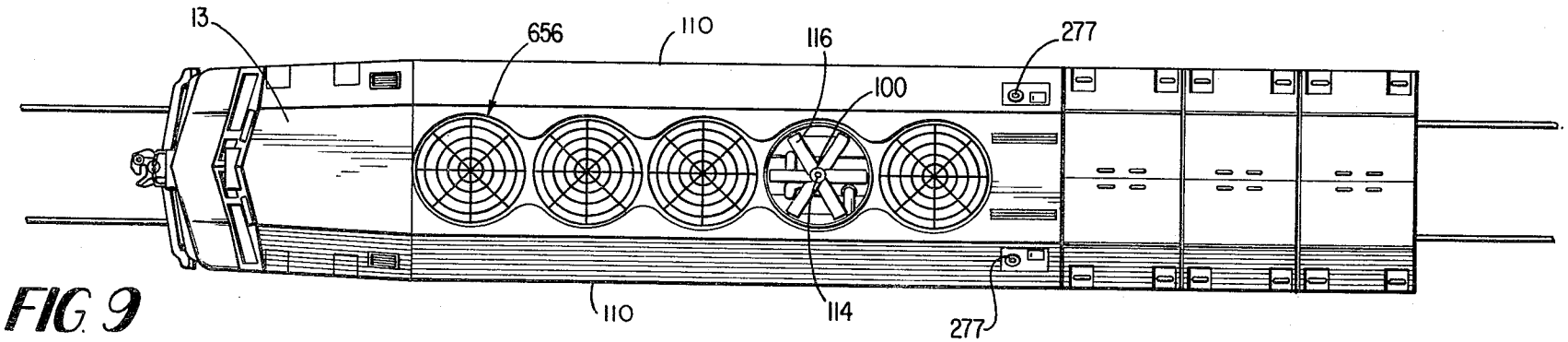

FIG. 9 is a top plan view of the support unit of FIG. 8.

Figure 10:
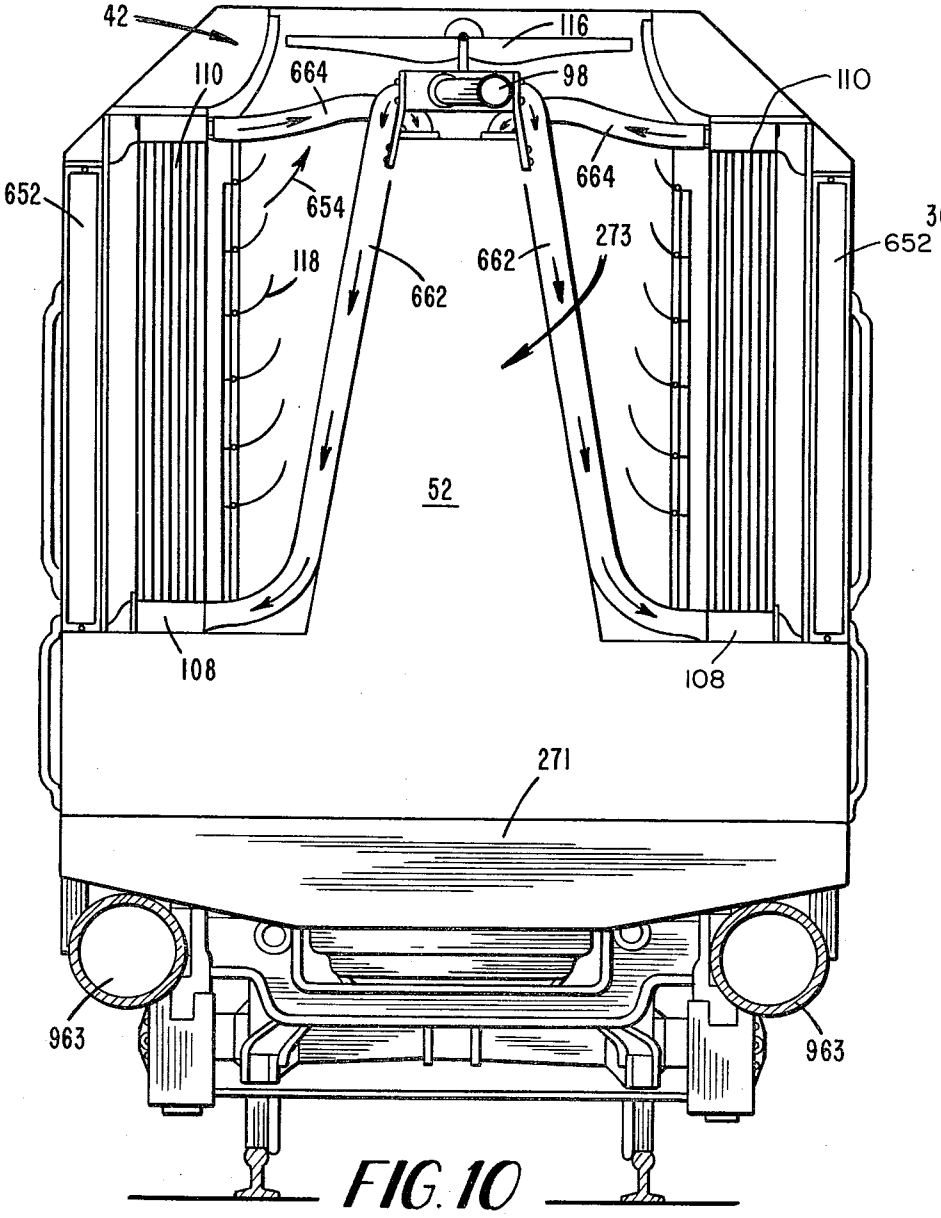

FIG. 10 is a section taken along lines 10—10 of FIG. 8.

Figure 11:
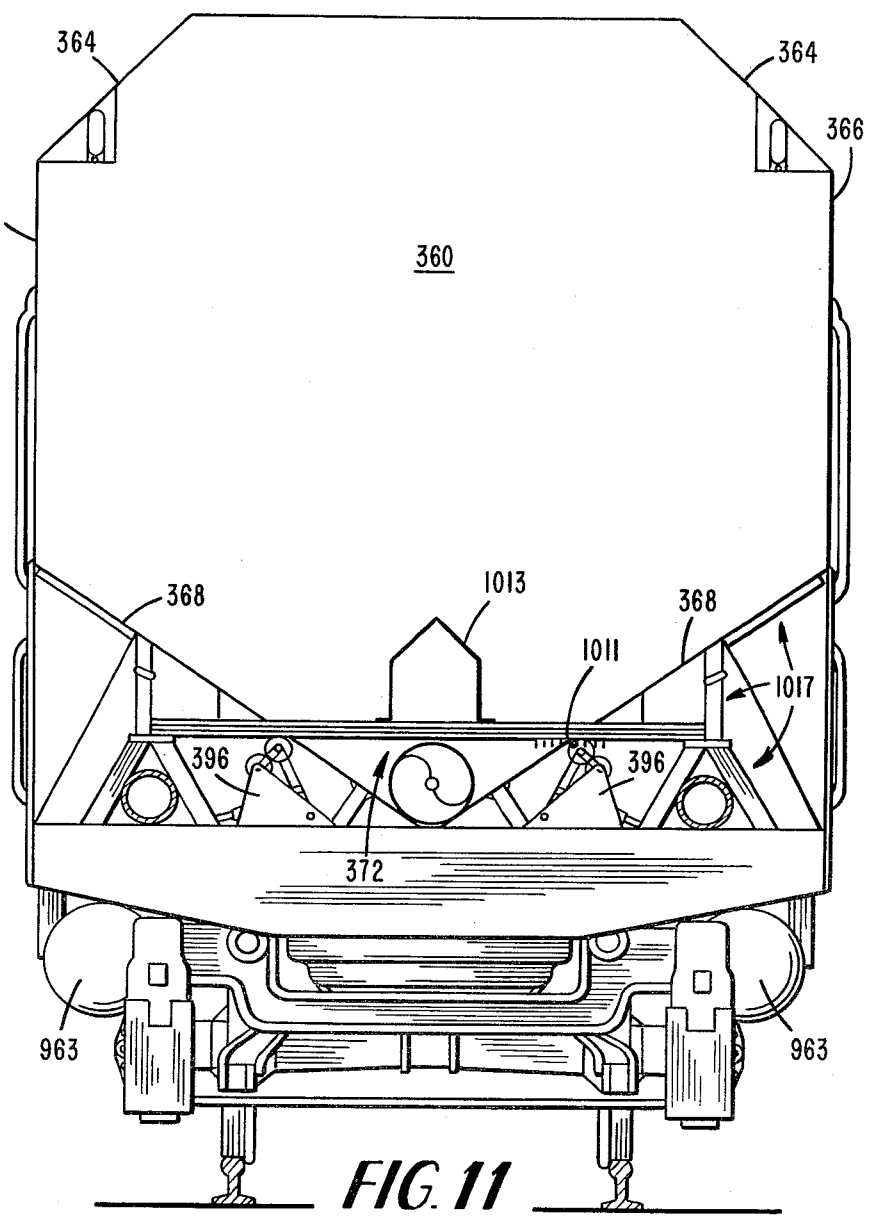

FIG. 11 is a section taken along lines 11—11 of FIG. 8.

Figure 12A:
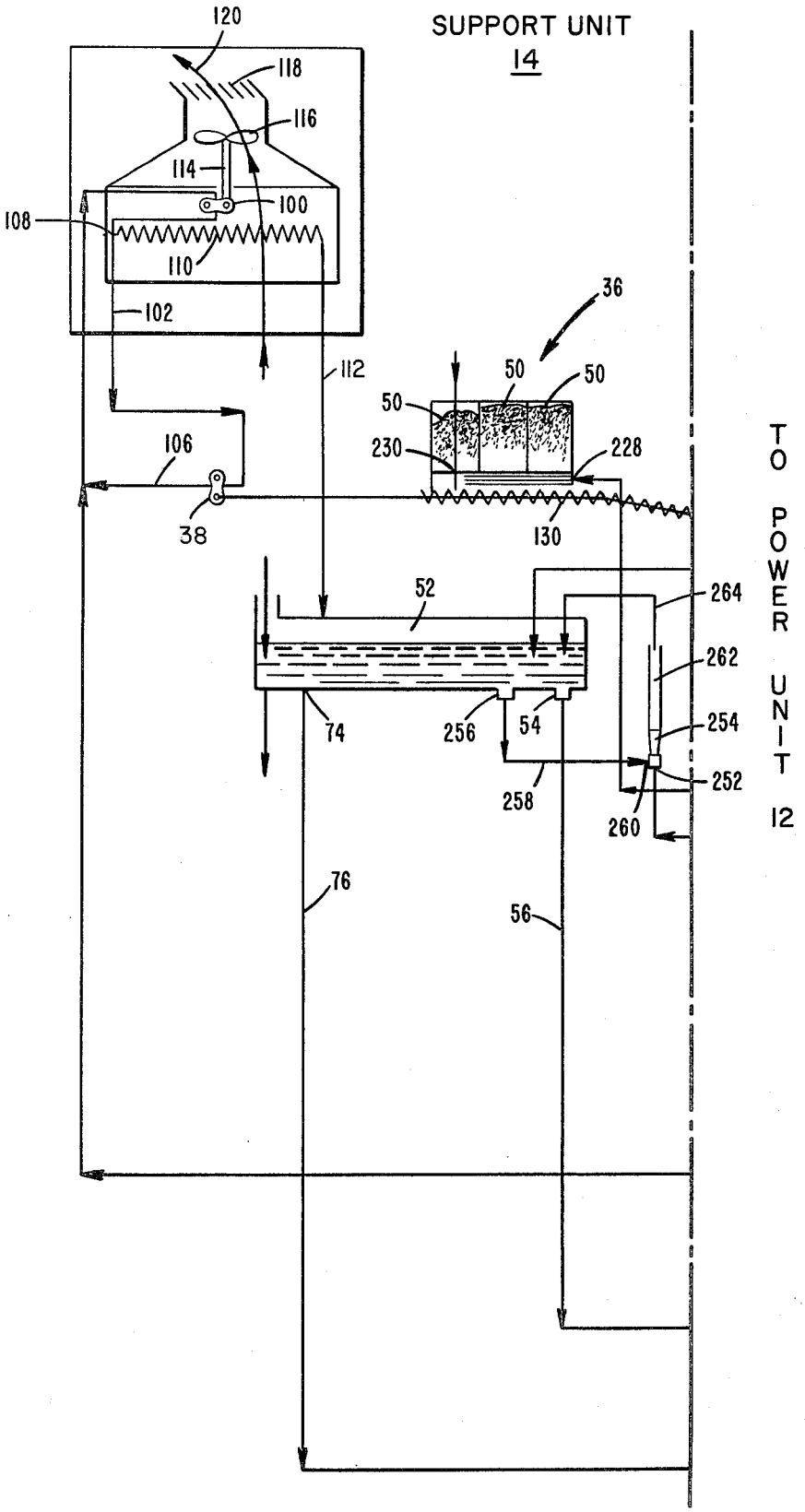

FIG. 12*a* and 12together constitute a flow diagram used to explain the operation of the various components comprising the power unit and the support unit of FIG. 1.

Figure 13:
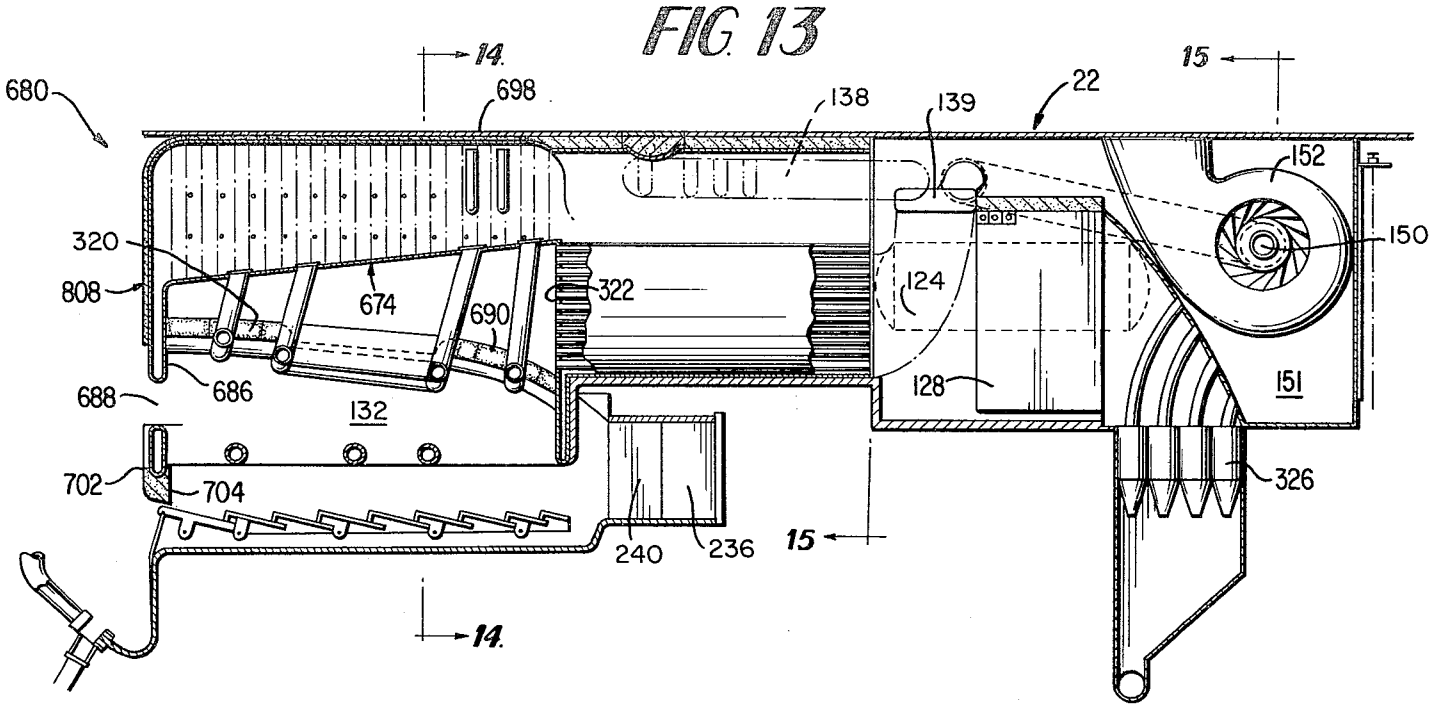

FIG. 13 is a side elevation, partially in phantom, of the furnace and steam boiler of FIG. 2.

Figure 14:
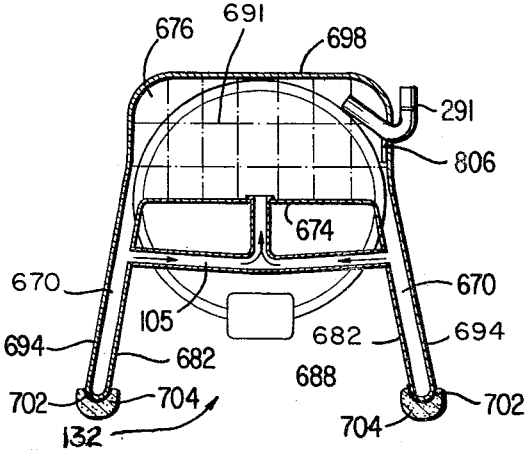

FIG. 14 is a section taken along line 14—14 of FIG. 13.

FIG. 15 is a section taken along lines 15—15 of FIG. 13.

FIG. 16 is a section showing a firetube mounted against a tube sheet.

FIG. 17 is a transverse section showing a firetube with a superheater tube mounted therein, the superheater tube being supported on separators.

FIG. 18 is a section showing the mounting of a staybolt in the furnace of FIG. 13.

Figure 19:
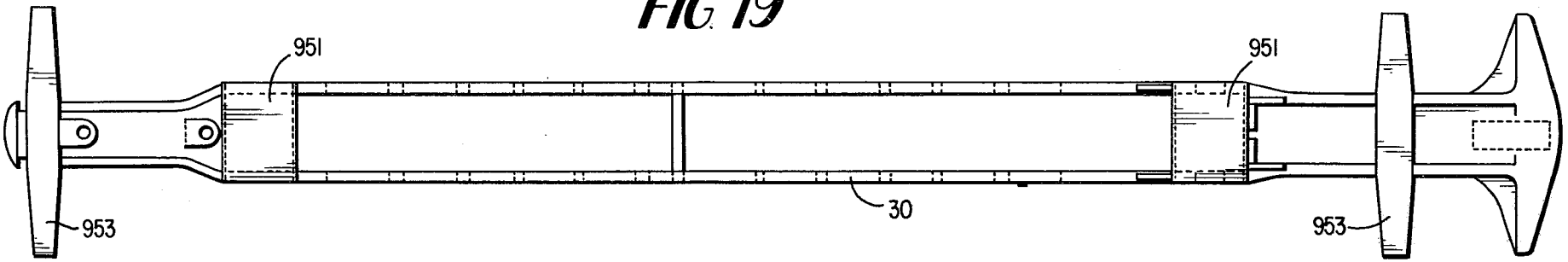

FIG. 19 is a top plan view of the support frame of the power unit of FIG. 1.

Figure 20:
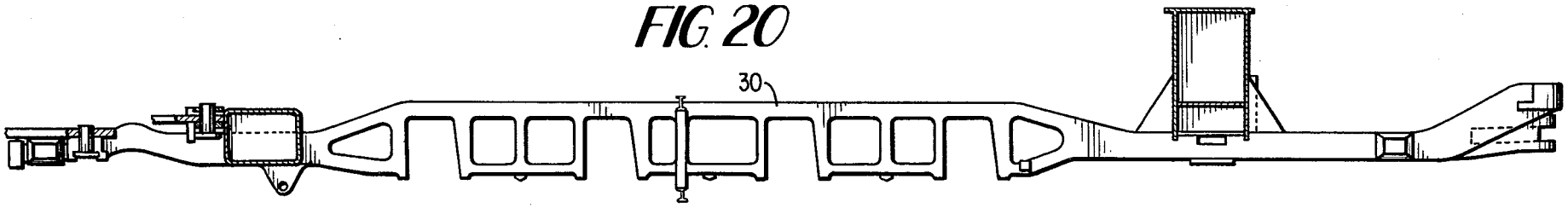

FIG. 20 is a side view of the frame of FIG. 19.

Figure 21:
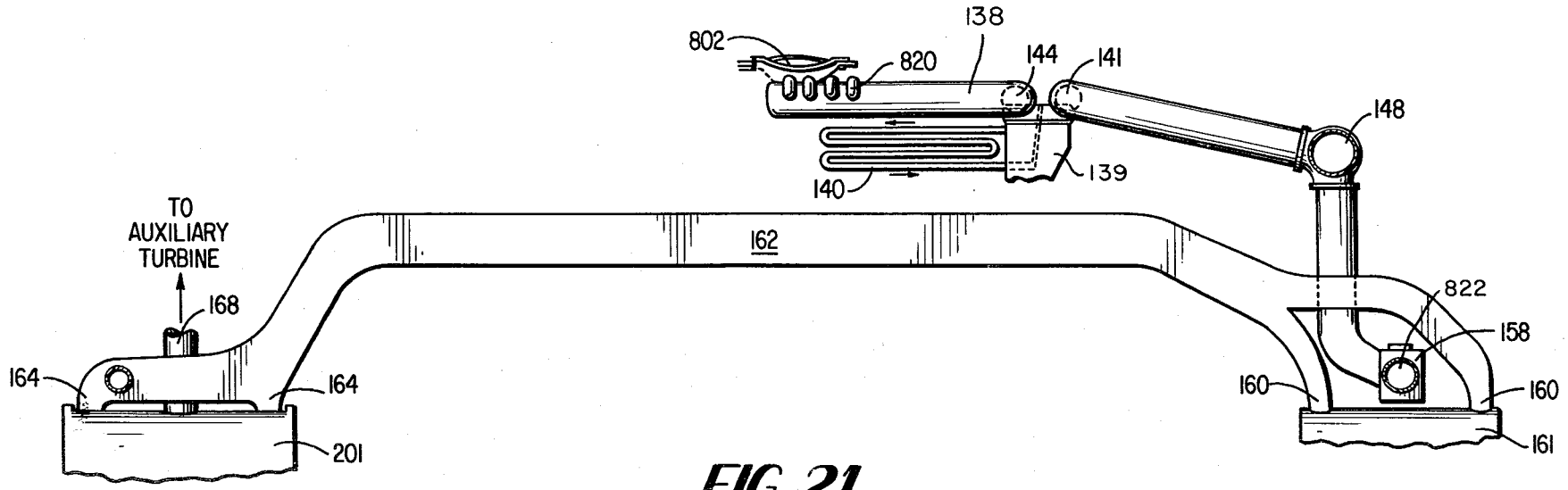

FIG. 21 is a partially schematic view showing the major elements of the main steam piping.

Figure 22A:
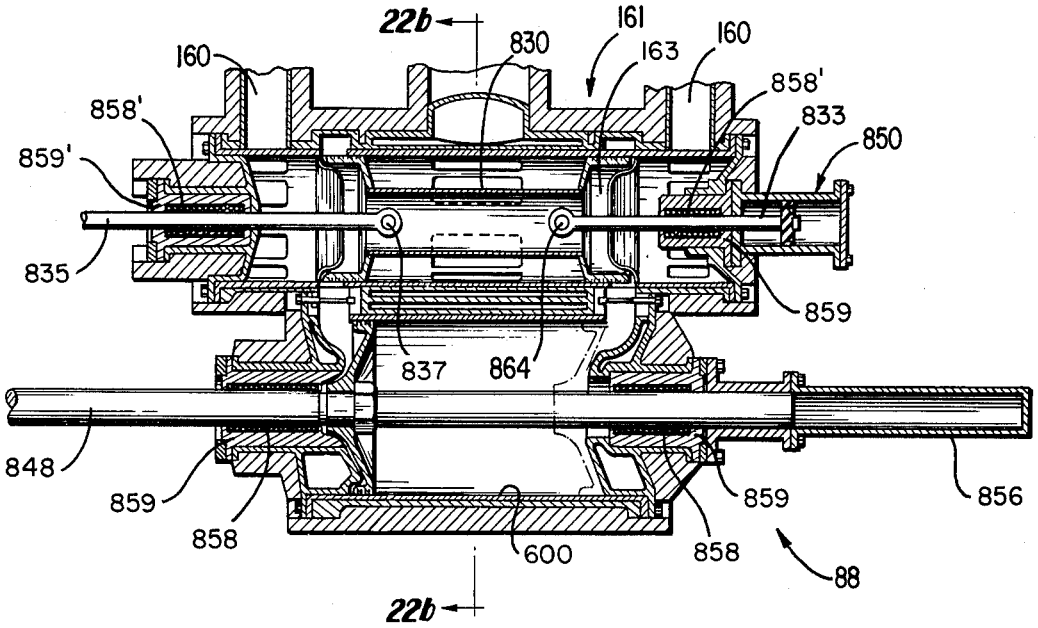

FIG. 22*a* is a sectional view of a high pressure cylinder taken through the plane defined by the valve and piston rods.

Figure 22B:
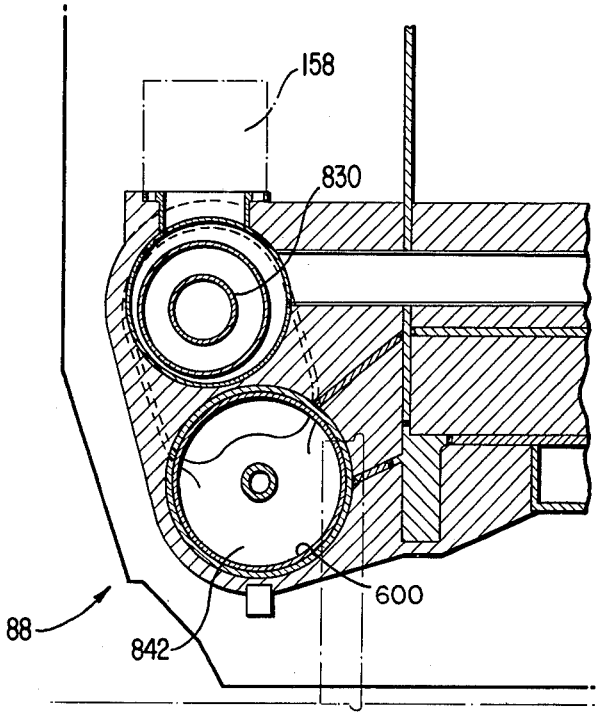

FIG. 22*b* is a section taken through lines 22*b*—22*b* of FIG. 22*a*.

FIG. 23*a* is a sectional view of a low pressure cylinder taken through the plane defined by the valve and piston rods.

FIG. 23*b* is a section taken along lines 23*b*—23*b* of FIG. 23*a*.

Figure 24:
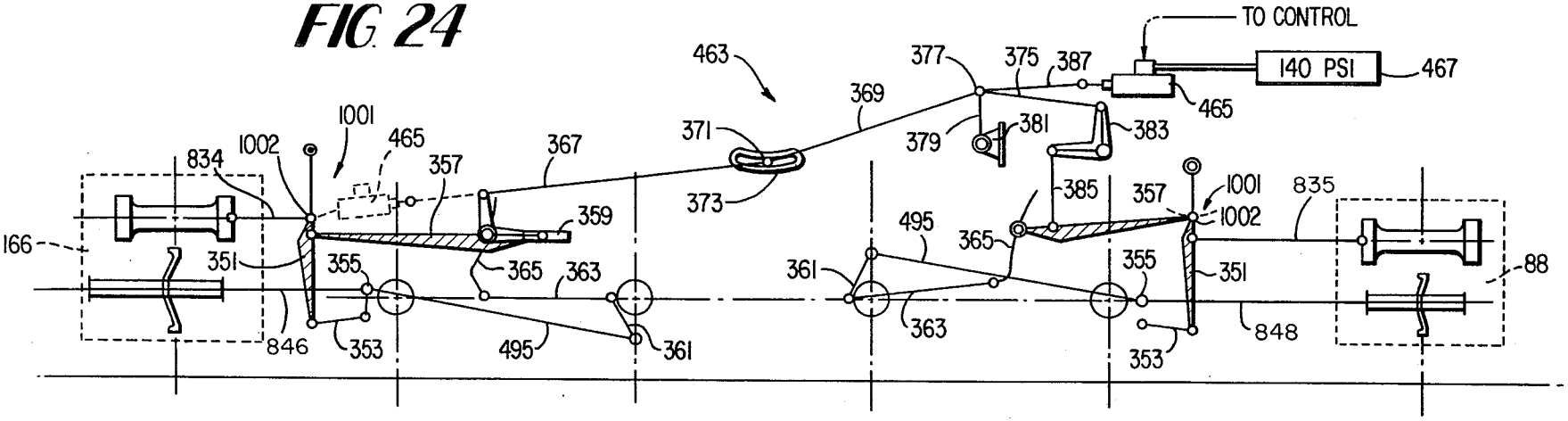

FIG. 24 is a schematic illustration used to explain the operation of one embodiment of the valve gear.

Figure 25:
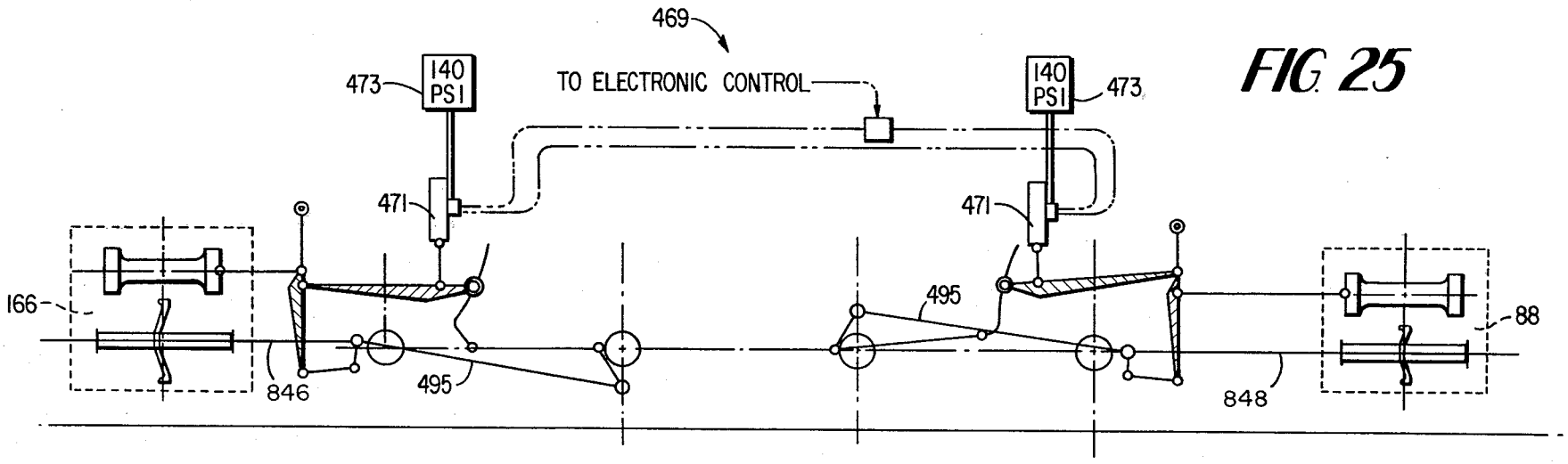

FIG. 25 is a schematic illustration used to explain the operation of another embodiment of the valve gear.

Figure 26:
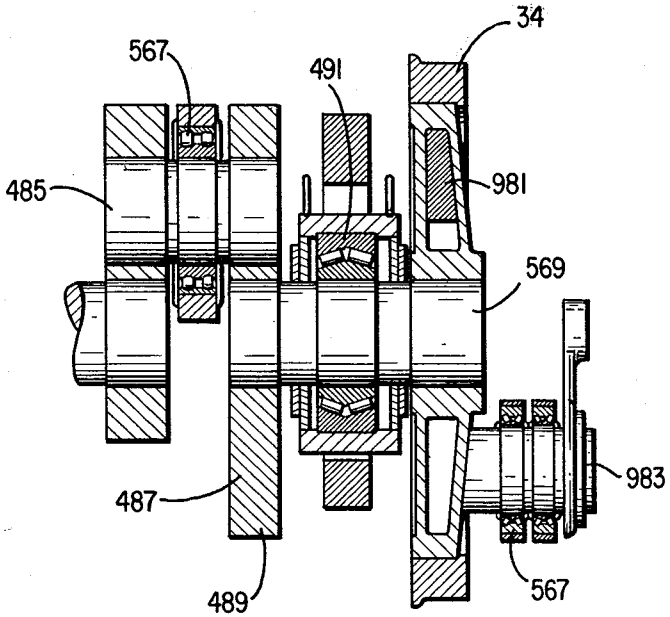

FIG. 26 is a transverse section showing a portion of the elements comprising the drive train.

Figure 27:
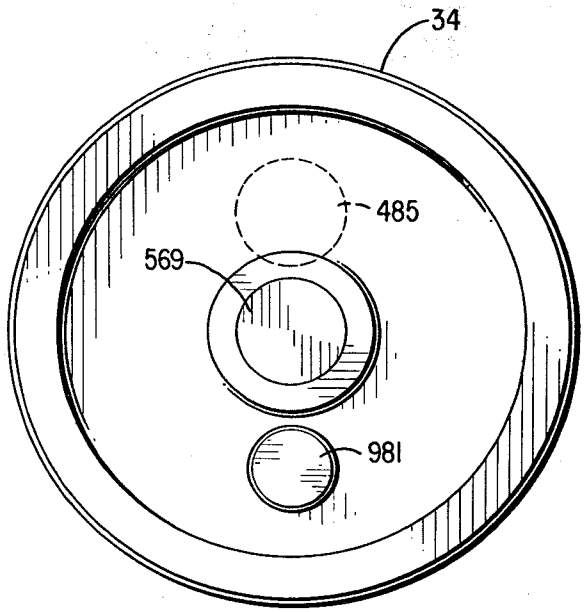

FIG. 27 is a schematic illustration of one of the drive wheels.

FIG. 28 is a front view of an embodiment of a coal module used on the support unit.

FIG. 29 is a side view of the coal module of FIG. 28.

FIG. 30 is a top view of the coal module of FIG. 28, with a bottom view in phantom.

FIG. 31 is a elevation partially cut away to illustrate the interconnection between the support unit and the power unit of FIG. 1.

FIG. 32 is a top view of FIG. 31 with the hoses being shown in phantom.

FIG. 33 is a section taken along lines 33—33 of FIG. 31.

Figure 34:
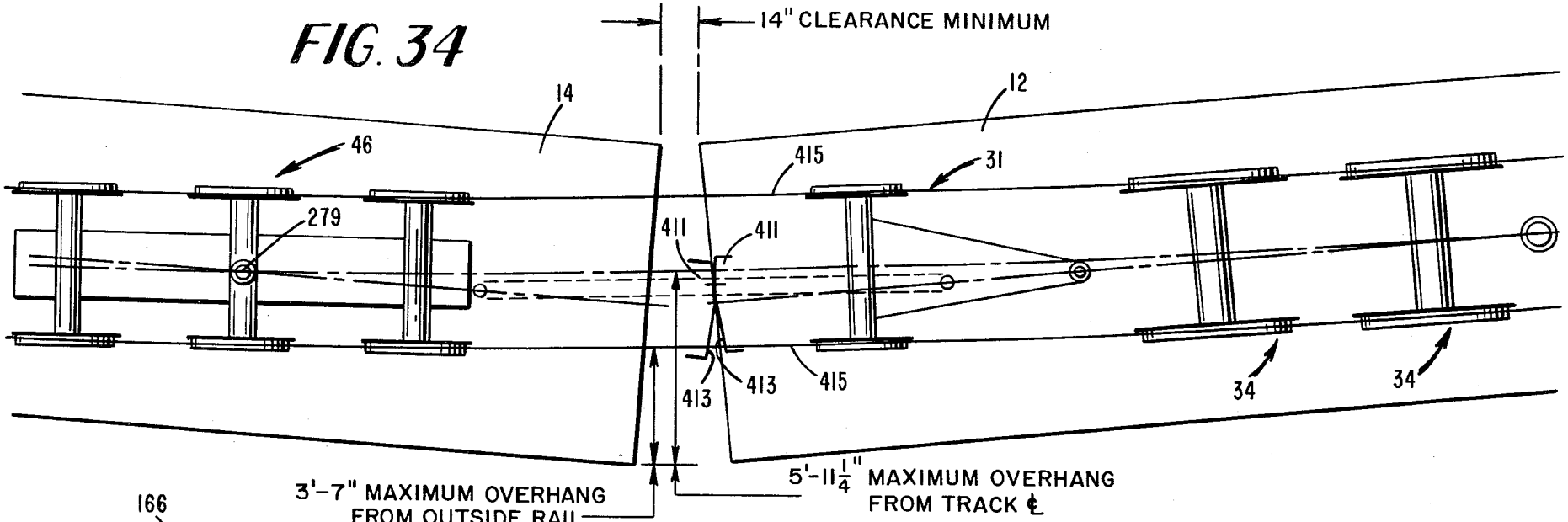

FIG. 34 is a schematic illustration used to explain the operation of the radial buffer face when the power unit and support unit negotiate a curve.

Figure 35:
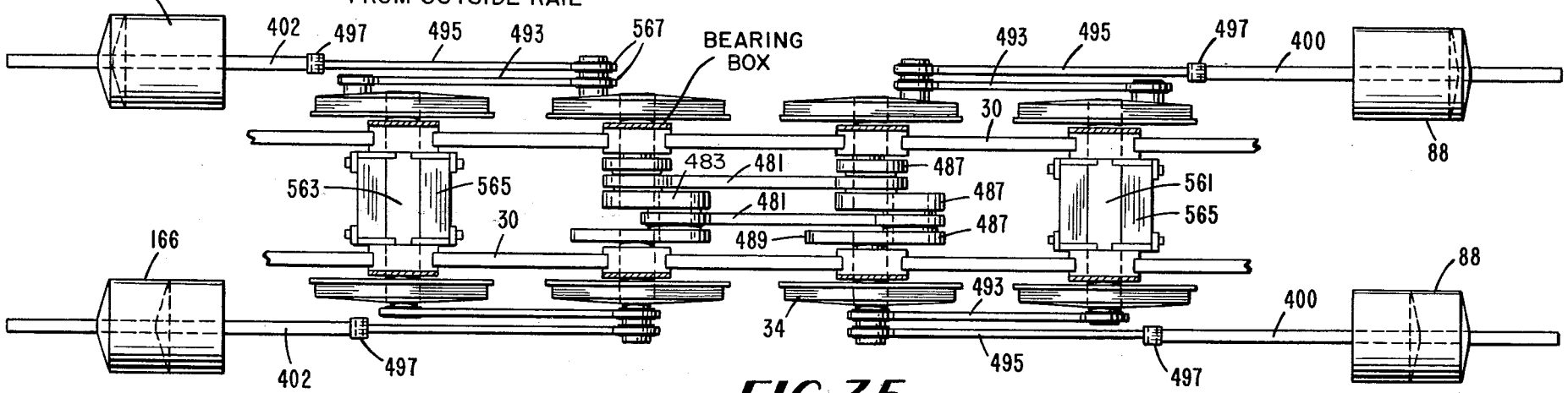

FIG. 35 is a bottom plan view showing the drive train.

Figure 36:
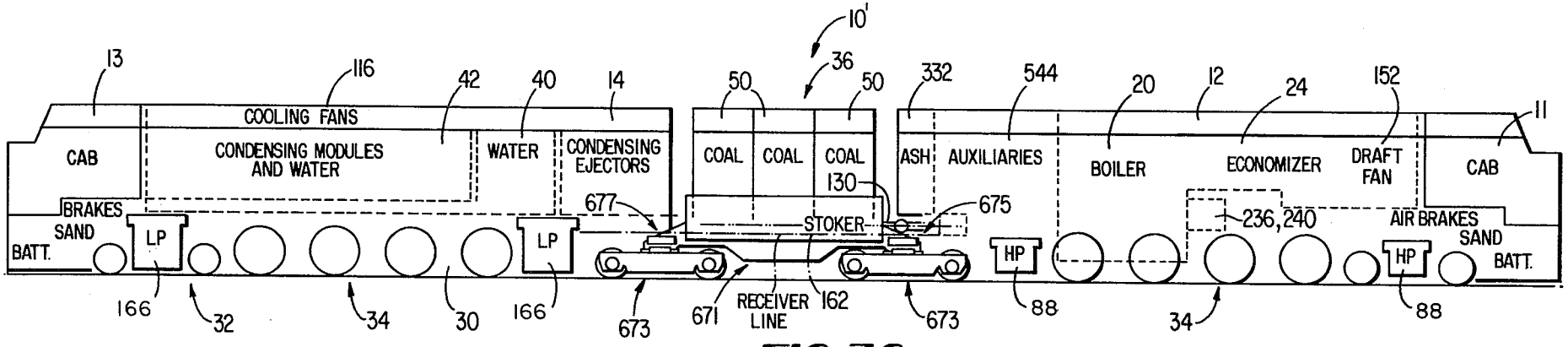

FIG. 36 is a schematic illustration of an alternative embodiment of a locomotive according to the teachings of the present invention.

Figure 37:
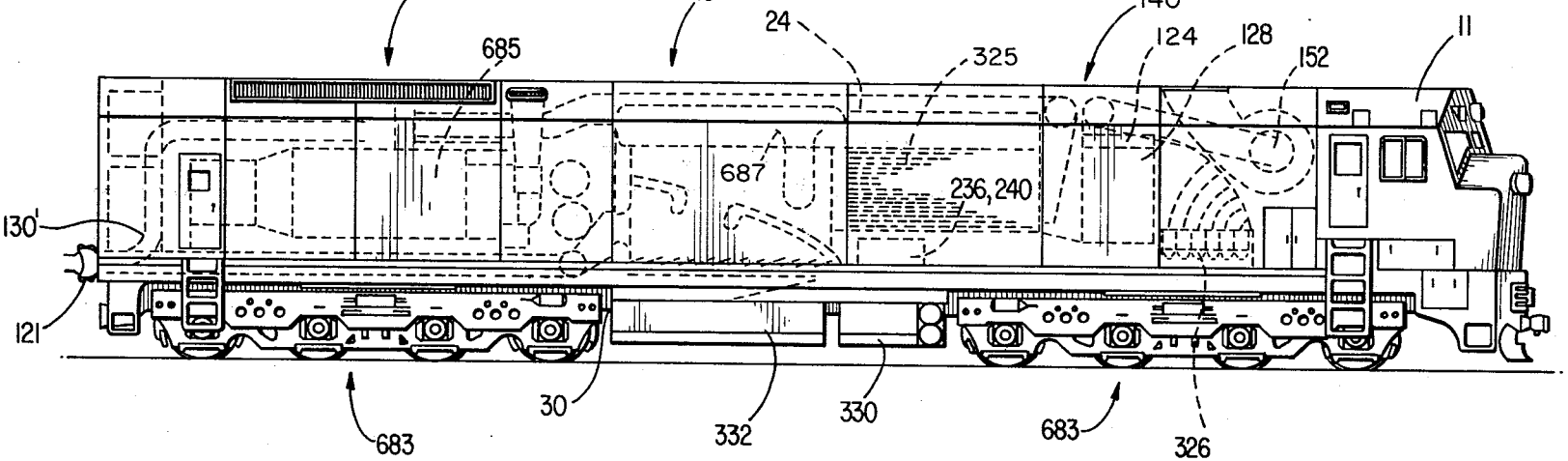

FIG. 37 is a schematic illustration of a steam-turbine locomotive embodying the teachings of the present invention.

DETAILED DESCRIPTION OF THE DRAWINGS

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 12B:
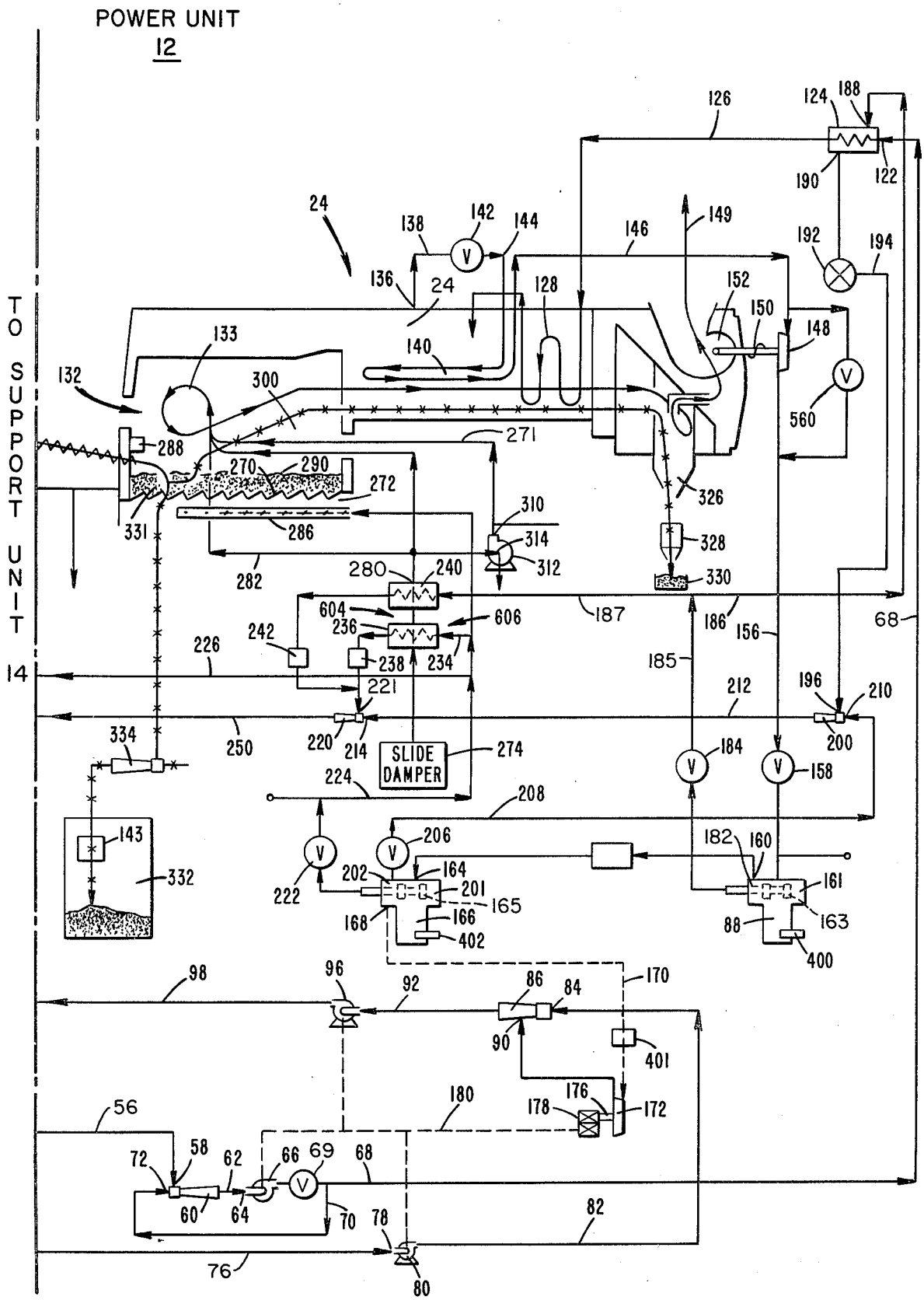

With reference to FIGS. 1–12, in general, and FIGS. 2 and 12, in particular, a generalized description of the complete system will be provided with the realization that the particular structure of the elements mentioned will be described in greater detail hereinafter.

The locomotive generally designated as 10 comprises a power unit 12 and a support unit 14. The units are connected by a coupling system 15, comprising a draw bar assembly 18 and a safety bar assembly 16.

Basically, the power unit contains the furnace and combustion system 20, the gas clean-up and exhaust system 22, boiler and steam generator 24 and the steam engines in the form of a pair of high pressure cylinders 88 and a pair of low pressure cylinders 166.

The power unit 12 is arranged on a frame 30 which is supported on a wheel arrangement in a 4-8-2 configuration. The leading four wheels are in a four wheel engine truck assembly 32 which provides guidance for the power unit when the power unit is moving in a forward direction. The eight wheel arrangement 34 constitutes the drive wheels for the locomotive. The power unit, also, has a cab 11 in front.

The support unit 14 basically comprises the coal storage area 36, the stoker motor 38, the water storage area 40, and the cooling assembly 42. The support unit is supported on a frame 44 which is mounted on two six wheels trucks 46. The support unit, also, has a cab 13 in front.

Fuel in the form of coal is carried on the support unit 14 in three modular coal packs 50. In a preferred embodiment, each pack 50 holds approximately 11 tons of two by one-quarter inch run-of-the-mine coal.

Water, about 10,000 gallons, is stored on the support unit in a water tank 52. Tank 52 contains an outlet 54 connected to a pipe 56 which terminates at an inlet 58 of a suction booster injector 60 on the power unit. The output of the booster injector travels through conduit 62 to the inlet 64 of a feedwater pump 66. As will be explained in greater detail hereinafter, the feedwater pump 66 is driven by exhaust steam.

A portion of the output of feedwater pump 66 travels through a return conduit 70, and is fed into a second inlet 72 of the suction booster injector 60.

The water tank 52 contains a second outlet 74 which is connected to a conduit 76 that provides a cooling water line. Conduit 76 takes cooling water from the water tank and directs it to the input 78 of a water circulation pump 80.

The output of the first water circulation pump 80 is directed by a conduit 82 to an inlet 84 on each of a pair of eductor condensers 86. Steam from the exhaust steam turbine 172 is received at a second inlet 90 on each of the eductor condensers 86 in a manner to be described in greater detail hereinafter. The output of each eductor condensor 86 is fed through a conduit 92, forming a cooling water return line, to an inlet 94 on each of a pair of second water circulation pumps 96. The output of these pumps is fed through a conduit 98 which defines a cooling water line.

Water flowing in the cooling water line 98 on the support line 12 powers a series of five hydraulic motors 100, and then passes through a conduit 102 to a hydraulic stoker drive 38 in the form of a hydraulic motor. Water passing through the stoker drive 38 returns to the cooling water line 98 via conduit 106. A tap 108 is provided in conduit 102 to allow a certain portion of the cooling water to pass through an array of heat exchangers as cooling coils 110 and then into the water tank 52 via conduit 112.

The hydraulic motors 100 each operate a shaft 114 which rotates a cooling air fan 116. Rotation of the fan draws cooling air across the cooling coils 110 and out the top of the support unit through a series of deflecting vanes 118 in a manner generally shown by arrowed line 120.

Returning now to feed pump 66, a portion of the output of the pump is conveyed on conduit 68 to an inlet 122 of an exhaust steam feedwater heater 124. Heated water emerges from the feedwater heater and travels through conduit 126 into a fin tube economizer 128 after which it is introduced into the steam generator 24.

Returning now to the coal storage area 36 on the support unit, coal from each coal package unit 50 is transported to the furnace 20 on the power unit 10 by way of a stoker screw 130.

In a preferred embodiment, the furnace 20 is a gas producer type. Within the furnace 20 there is defined a furnace chamber 132 where coal combustion takes place. Since the combustion process within the furnace chamber 132 relies on steam generated by the locomotive system, the details of the combustion process will be delayed until after a discussion of the steam generator has been presented. Suffice it to say at this point that heat is released by combustion in the form of radiant energy and hot flue gas which is introduced into the steam generator 24 to convert the water introduced from the economizer 128 into steam which exits from the steam generator 134 via outlet 136. Steam appearing at outlet 136 travels through a drytube 138 into a superheater 140. A pressure reducing and shut-off valve 142 is interposed between the outlet 136 of the steam boiler and the superheater header input 144 of the superheater.

Superheated steam from the superheater 140 passes through a conduit 146 into an induced draft (ID) fan turbine 148. Connected to the ID fan turbine 148 by a drive shaft 150 is an ID fan 152, which in a preferred embodiment is a pair of squirrel cage blowers. The steam then exits the ID fan turbine 148 and passes through a conduit 156 into a pair of Wagoner throttles 158. Each throttle 158 is associated with a high pressure cylinder 88. The piston valves 163 in the valve chest 161 admit main steam alternately into the front and back of the cylinder, forcing the pistons 400 into a reciprocating mechanical motion.

Each high pressure cylinder 88 contains a pair of Weiss ports 182. Steam extracted from Weiss port 182 passes through a non-return valve 184 and through conduit 185. A portion of the steam in conduit 185 passes into a conduit 186 and into the steam input 188 of the exhaust steam water heater 124. The steam passes out of the exhaust steam water heater 124 via outlet 190 and then through a condensate trap 192. From the trap the steam travels through a conduit 194 and into the inlet 196 of an ejector 200.

At the same time, a portion of the high pressure exhaust steam branches off into conduit 187 and passes through a receiver steam air heater 240 and then through a condensate trap 242 after which it merges at the inlet 221 of ejector 220. The output of ejector 220 travels through conduit 250, which is a condensate and exhaust steam line, into an inlet 252 of yet another ejector 254 that is on the support unit.

Steam exhausted from outlets 160 of each high pressure cylinder 88 passes to an associated receiver pipe 162 and from there to an inlet 164 of a low pressure valve chest 201 containing the piston valve 165. The piston valves admit receiver steam alternatively into the front and back of the low pressure cylinder 166 forcing the low pressure pistons 402 into a reciprocating mechanical motion which is coordinated with the motion of the high pressure pistons.

Exhaust steam from each outlet 168 of low pressure cylinder 166 passes through a conduit 170 through an oil separator and into an exhaust steam turbine 172. There are two exhaust steam turbines 172, one at each low pressure cylinder exhaust 168 arranged to drive a shaft 176. This shaft through a speed reduction gear 178 causes the main power shaft 180 to rotate and thereby provide motive power to the feed pump 66, the first water circulation pump 80 and the second water circulation pump 96, and an air roots blower 312.

Each low pressure cylinder 166 also contains a pair of Weiss ports 202. Low pressure steam exhausting from Weiss port 202 is fed through an associated non-return valve 206 and then through a suitable conduit 208 into an inlet 210 of ejector 200. The output of ejector 200 is fed through a conduit 212 into an input 214 of a second ejector 220.

The low pressure exhaust steam from each of the low pressure cylinders 166 passes from the other Weiss port 202 through an associated non-return valve 222 then through a suitable conduit 224 that contains many branches which lead to various parts of the system. A first branch 226 leads from the power unit through a suitable connection to the support unit and provides coal wetting steam at a point 230 where fuel, in the form of coal, is exiting from one of the coal package units 50. A second branch 234 passes through a steam air heater 236 and then through a condensate trap 238 and finally into an inlet 221 of ejector 220.

The water tank 52 contains another outlet 256. Water from this outlet is fed via conduit 258 to an inlet 260 of ejector 254. The output of ejector 254 travels directly into a water mixer 262 the output of which travels through conduit 264 into the water tank 52.

Having described the steam production phase of the system, attention is now drawn again to the furnace area 20.

The furnace basically comprises a furnace chamber 132 in the bottom of which is disposed a shuffling or oscillating grate 270 below which is defined a wind box 272. Air from a slide damper 274 passes through the low pressure exhaust steam air heater 236 and the receiver steam air heater 240 from which it exits as heated air. At the outlet 280 of air heater 240 the heated air branches off into three directions. One branch in conduit 282 is primary air which is introduced into the wind box 272 below the grate 270.

A portion of the exhaust steam from the low pressure cylinders 166 as carried by the conduit 224 is introduced into an injector 286 positioned below the grate within the wind box 272.

As stated before, coal is fed into the furnace chamber by a stoker screw 130. The coal is distributed by twin ram spreaders 288 or other means onto the grate 270 to define a fuel bed 290. Combustion within the furnace chamber occurs in two stages. In the first stage, coal burns in the primary air supplied under the grate 270. This air is insufficient for complete combustion. The products of the first stage of combustion are cumbustible gases which are burned to completion in over fire air region 300 above the fuel bed 290. This is the second stage of combustion. Gas production is further enhanced by ejection of steam into the under fire air in the approximate mass ratio (steam-to-air) of 1-to-10. This method of combustion results in producer gas which components include hydrogen and carbon monoxide.

The producer gas burns above the fuel bed in the secondary over fire air region 300. Hot combustion gases move in a cyclonic path 133 as a result of the introduction of a portion of the secondary heated air from the outlet 280 of the receiver steam air heater 240 along with the introduction of swirling air provided at the output 310 of an air turbulator 312. The input 314 of the air turbulator 312 receives the heated air from the output 280 third branch of the air heater 240. The air turbulator or air roots blower 312 is mechanically driven by the main power shaft 180 in the manner described hereinbefore.

The hot combustion gases move in a cyclonic path through a furnace arch 320 and through the back tube sheet 322 into the firetubes 324. The combustion gas or flue gas may also carry with it particulates as it passes through the fire tube 324. Therefore, the combined mixture of flue gas and particulates are introduced into a gas cleanup and exhaust system 22. First the mixture enters a battery of cyclonic dust collectors 326 for gas clean-up. The cyclonic dust collectors 326 discharge the particulate into a separator or hopper 328 from which the contents are deposited into a pan 330, which is of modular construction and easily removed for dumping.

After separation, the flue gas escapes from the collectors 326 and is released to atmosphere after passing through the pair of draft fans 152.

During combustion of the coal in the furnace 132, ash is produced. The shuffling movement of the grate 270 causes the ash to be passed to an ash pan 331. The ash pan 331 is periodically cleared by a steam jet which transports the ash to a cyclone separator 143 and then into an ash package 332 removably mounted on the back of the power unit 12. The ash from the grate is introduced into the ash package 332 with the aid of a steam ejector 334 in order to confine fugitive dust during ash ejection.

Having completed a general description of the elements constituting the locomotive system, the specific details of those elements will now be described.

With reference to FIGS. 8–11, the details of the support unit 14 will be presented.

The support unit 14 basically comprises a frame 44 which is supported on two six wheel trucks 46. Near the right-side portion 350 of the support unit is defined the coal storage area 36. In a preferred embodiment, three removable coal package units 50 constitute the coal storage area.

With reference to FIGS. 11 and 28–30, the details of one modular coal pack 50 are shown. The coal pack 50 is a slender structure defined by a front wall 360 a back wall 362 each of which is configured to meet AAR clearance standards. As shown in FIG. 28 walls 360 and 362 are generally octagonal in shape, although other shapes are contemplated. The two walls are generally normal to the frame 44 and are spaced coterminously from each other. Two top side walls 364, two middle side walls 366, and two bottom side walls 368 are joined to a portion of the periphery of front wall 360 and back wall 362 to define a volume 370 for receiving coal. This wall structure also defines a bottom opening 372 through which coal may pass to the coal stoker and a top opening 374 through which coal may be introduced during loading. A pair of hinged doors 376 which are secured by transversed hinges 378 provide a cover for the top opening 374.

Disposed transversely along each bottom side wall 368 are three equally spaced outwardly extending members 380. Secured to the distal ends of these members is a transversely extending frame member 382.

On either side of the bottom opening 372 along the edge defined by forward wall 360 and back wall 362 are a pair of members 384 whose ends are welded to the ends of members 382. Disposed between members 384 is an elongated frame member 386 whose ends are joined to the mid portions of members 382. Frame member 386 and frame members 384 are generally parallel to each other. These frame members are configured to provide slots 390 within which are received four sliding doors 392. Each of the doors contain suitable opening mechanisms such as a row of teeth 1011 which provide a rack for a rack and pinion door opening mechanism 396 associated with each of the doors.

With reference to FIGS. 8 through 11, the water cooling area 42 comprises a plurality of conventional heat exchangers 110, five such heat exchangers being disposed along each side 651 and 653 of the support unit. Covering each one of the heat exchangers is a series of louvers 652 through which air enters from outside of the support unit and passes through the heat exchangers. On the other side of each heat exchanger is a series of deflecting vanes 118 which act to direct the air passing through the heat exchangers in the general direction as indicated by arrow 654.

On top of the support unit in line with the heat exchangers are a series of longitudinally disposed fan assemblies 656. Each fan assembly comprises one of the hydraulic motors 100, and one of the fans 116, as described hereinbefore.

Water from the eductor condensers 86 on the power unit travels through conduit 98 on the support unit in the direction indicated by the arrow 660 in FIG. 8. This water is used to power the hydraulic motors 100 after which it is conveyed through conduit 662 to the heat exchanger 110 where the water is cooled. The water then travels through conduit 664 and into the water tank 52. It should be pointed out that a conduit 662 and a conduit 664 is associated with each of the heat exchangers 110.

The following is a description of the physical placement of the system components on the power unit. As shown in FIGS. 1 and 2, the power unit includes an elongated frame 30 for supporting the structure of the power unit. Supporting the frame are four sets of drive wheels 34, two sets of forward guide wheels in a 4-wheel truck 32, and a rear set of guide wheels in a 2-wheel truck 31. Secured to the frame is an elongated body or hood 610 defining a cavity for receiving the various elements of the power unit.

With reference to its orientation in FIG. 2, the power unit cavity is filled in the following manner. At the extreme upper right hand corner outside of the cavity, there is provided cab module 11 which contains all of the elements necessary for the engineer to operate the locomotive. The back wall 612 of the cab rests up against a front wall 614 of the hood. The cab 11 is removably secured to the power unit by conventional fastening means, such as bolts (not shown). Positioned below the cab area within the cavity 612 on both sides of the frame centerline is a sand package 616 as well as batteries 618.

Positioned behind the front wall 614 at the top portion of the cavity is the plenum 151. The pair of exhaust fans 152 are placed within the plenum with their exhaust ports merging out of the top of the hood 610. Positioned further behind the draft fans in the top portion of the cavity are the fintube economizer 128 and the superheater header 139. Positioned next to the economizer along side hood side wall 622 is the feedwater heater 126.

Below the plenum on either side of the frame centerline are the two high pressure cylinders 88. These cylinders are positioned on the frame, one cylinder being positioned along each of the side walls 622 and 624. Positioned below the exhaust ports for the fans in the lower portion of the cavity and behind the high pressure cylinders is the array of cyclone separators 326 below which is located the pan 330.

Occupying a major portion of the cavity behind the feedwater heater is the furnace 20. At the bottom of the furnace nearest the frame of the power unit is the shuffling grate 270 on which fuel is burned. Positioned forward of the general area defining the furnace is the pair of heaters 236 and 240. Positioned above the air heaters, ahead of the furnace is the boiler section 24.

Positioned behind the furnace, in the lower central portion of the cavity is the coal conveyor screw and stoker 130. Above this structure is located the primary feedwater pump 66, second water circulation pumps 96, and the eductor condensers 86. At the rear end of the power unit is the ash separator 143 and replaceable ash package.

Below the coal conveyor screw 130 near the rearward portion of the power unit are the two low pressure cylinders 166 located on opposite sides of the frame 30.

With reference to FIGS. 1–13, the locomotive 10 converts chemical energy in coal to work. The work is done by a tractive effort force acting through a distance. Chemical energy is released by combustion in the furnace chamber 132 resulting in hot flue gas containing combustion products and excess air. A portion of the chemical energy is transformed by radiative, convective, and conductive heat transfer into internal energy in water which is heated to the boiling point in the steam boiler 24 and to superheated steam conditions in the superheater 140. The steam is conducted to the pistons 400 in the high pressure cylinders 88 and then to the pistons 402 in the low pressure cylinders 166 where its internal energy is converted into expansion work that is transmitted to driving wheels 34 and into tractive effort at the drawbar assembly 18 by a mechanical transmission consisting of piston rods, connecting rods, and cranks. The mechanical transmission and associated structure is discussed in detail hereinafter. Spent steam is condensed in eductor condensers 86, cooled by forced convective heat transfer to ambient air, and stored in the water tank 52 on the support unit 14 until it reenters the boiler 24.

The process is characterized by two major flows, air/gas and water/steam, whose paths interact resulting in transfer of thermal energy. The process is designed to maximize energy conversion efficiency of maximum recovery of available heat at every stage of the cycle. Some of the factors which improve thermodynamic efficiency are associated with how the flow paths interact; for example, use of exhaust flue gas for feedwater heating, use of extraction steam for air preheating, use of extraction steam for feedwater heating, and other uses which become evident hereinafter.

With regard to the air/gas flow path, furnace draft is provided by the induced draft (ID) fans 152. Air enters the locomotive system through the inlet air damper 274 which is normally in a fully open position but can be closed in order to shut off the air supply for shut down or emergency conditions. The air passes through two stages of preheating by first passing through exhaust steam air heater 236 and then through receiver steam air heater 240, each utilizing extraction steam from the low pressure cylinders 166 and high pressure cylinders 88, respectively. The air divides into three separate paths whose individual flows are determined by inherent flow resistance factors. Approximately 35% of total air flow passes through a duct 282 into the wind box 272 under the furnace grate 270. Approximately 65% of total air flow is delivered by duct 271, which contains a series of spaced ports 145, above the burning fuel bed 290 in such a manner as to create cyclonic motion of gases in the firebox 132 as indicated by the arrows 133 in FIG. 12. Several percent of total air flow can also be injected at higher velocity by the air turbulator-blower 312 to augment the cyclonic motion.

Hot combustion gas passes through an opening 147 in the arch 320 to the upper furnace region 103, transferring heat to boiler water through the furnace walls and arch tubes in the form of circulators 105 and enters the firetube section of the boiler 24. As the gas passes through the firetubes 324, it transfers thermal energy to boiler water surrounding the firetubes, and to steam in superheater tubes 140 inside the firetubes. Flue gas emerges from the firetubes into the flue gas plenum 151, passes through the economizer where feedwater is preheated nearly to its boiling point, and then enters the array of cyclone separators 326 where fine solids and dust carried over from the furnace are collected. The pair of ID fans 152 draw their suction from multicyclone exhaust and spent combustion gases are discharged upward to the atmosphere as indicated by arrows 149.

Water is stored in the storage tank 52 on the support unit 14, and delivered by gravity to the suction booster injector 60 to provide positive suction head into the boiler feedwater pump 66. The feedwater pump 66 is driven directly from the exhaust steam turbine shaft 176 via the speed reduction gear 178; thus, pump speed is self-regulated in proportion to steam flow. A flow control valve 69 downstream of the pump 66 provides feedwater trim control. Boiler feed is pressure delivered to the feedwater heater 124 (heated by extraction steam from the high pressure cylinder 88), then to the economizer 128 and to the boiler water space 135 as required to maintain the proper water level.

Steam from the boiler is collected in the dry tube 138 and delivered to inlet 144 of the superheater header 139. Each superheater tube 140 has two loops in series, each loop in its own firetube. Steam is returned to the superheater outlet header 141, then flows through the induced draft (ID) fan turbine 148 to the throttle valves 158 before entering the high pressure engine valve chest 161 of each of the two high pressure cylinders 88. The Weiss port 182 supplies extraction steam through the non return valve 184 to the feedwater heater 124 and combustion air preheater 240. Steam exhausting from the high pressure cylinders 88, one of which is located on either side of the frame 30 near the forward area of the power unit, passes through the equalizing receiver 162 into the low pressure engine valve chest 201 of each low pressure cylinder. As best shown in FIGS. 3 and 21, an equalizing receiver 162 is longitudinally disposed on either side of the power unit. Near the rear portion 600 of the power unit each receiver 162 is operatively connected to one of the low pressure cylinders 166. A Weiss port 202, in each low pressure cylinder 166, supplies extraction steam through non return valve 222 for undergrate steam injection and combustion air preheating. Extraction steam condensate from both air preheaters 236 and 240 and feedwater heater 124 is returned to the water tank 52 through injectors 220 and 254.

Steam exhausting from the low pressure cylinders 166 passes through the pair of low pressure exhaust turbines 172 on the common shaft 176 and into the pair of eductor condensers 86 where steam is condensed to water by intermingling with recycled tank water. The water jet into the condensers 86 is propelled by the first water circulation pump 80, which is driven directly from the main power shaft 180. Second water circulation pump 96, which is driven from the exhaust turbine shaft, via speed reduction gear 178 and main shaft 180, draws suction from the eductor condenser 86 and delivers high pressure water to the support unit 14 to power water turbines 100 and 38 for driving cooling fans 116 and the coal feed screw 130, respectively. All water delivered by water circulation pump 96 is finally discharged into cooling coils 110 transferring heat from the water to ambient air, and then drains back into the water tank 52.

With reference to FIGS. 2 and 12, coal handling and distribution in the power unit 12 is handled in the following manner. Coal is conveyed from the support unit 12 by a standard stoker screw 130 with articulated joint connections 121 between the support unit and the power unit. Rotation of the screw 130 brings coal to the head of the stoker. Periodically, according to the firing rate required, the twin stoker rams 288 distribute coal forward over the coal bed. The rams are spring powered with steam return. They provide even coal distribution over the bed. The articulated slip joint 121 connecting power unit and support unit coal screws 130 and 130' is accessible when the ash box 332 is removed. Where the coal screw 130 must bend, universal joints 127 are provided. Each of the universal joints in the coal screw is sealed or provided with oil lubrication.

As best seen in FIGS. 2 and 13, the furnace 20 is a gas-producer type. Coal fed into the furnace chamber 132 is initially gasified in a thick fuel bed 290 supported by grate 270. Primary air and steam are introduced into the windbox 272 below the grate. Gaseous products of this first combustion stage are burned in overbed region 300 in secondary overfire air. Hot combustion gases move in a cyclonic path 133 through the furnace arch 320 and through the back tube sheet 322 into the firetube convection pass. Heat is transferred by radiation from the fuel bed and flames, and by convection from hot gas to water-cooled surface for raising steam that encloses the furnace chamber.

Furnace volume (grate to tube plate) is approximately 380 cu. ft. A typical heat release rate at "notch-8" is $56\times10^6$ BTU/hr, corresponding to a firing rate of 4300 lb/hr for coal with heating value of 13,000 BTU/lb.

The furnace grate, shown in FIGS. 2 and 13, is a "Detroit CC Grate" or equivalent, with lateral rows of grate bars 281, each bar having a series of closely spaced pinholes 283. Alternate grate bars move continuously in a slow, reciprocating or "shuffling" motion. The grate area is approximately 70 $ft^2$, and maximum coal loading is approximately 60 $lb/ft^2hr$. The fuel bed would normally reach a depth of one foot with newly injected coal on top, and shrunken coal particles and combustion residue below. The shuffling motion of the alternate grate bars 281 moves material deep in the fuel bed, consisting primarily of ash and clinkers, toward the rear of the furnace (that is, toward the point of fuel distribution) where it falls into a temporary ash pan 331. Careful attention to prevention of leaks in the windbox container 272, plus use of pinholes in the grate, assures uniform distribution of steam and air through the fuel bed.

An air-to-fuel ratio of approximately 13:1 is maintained to insure adequate air for combustion with some excess to avoid occurrence of corrosive, reducing conditions in the furnace.

The fuel bed temperature stays relatively cool because of partial combustion and steam injection. This method of combustion is inherently low in $NO_x$ production because of low fuel bed and combustion temperature. It is also low in particulate emission because of low air and gas velocities passing up through the fuel bed.

Within the framework of the combustion within the furnace 20, ash is a non-combustible component of coal that can account for up to approximately 15% of the weight of the coal. Ash consists of several constituents that vary in type and composition for different coals, and is a somewhat glassy material that becomes soft, sticky, and fluid as its temperature is increased. It remains after combustion in several possible forms depending on the type of combustion, and the temperature reached by the ash material in the combustion process.

In the furnace chamber 132, fuel bed temperatures are low, and ash components are expected to stay in dry powder form and agglomerate into popcorn-size cinders and clinkers. Coal particles and lumps shrink as they are consumed in the fuel bed 290. The ash material oozes out of the coal, flakes off, or agglomerates into medium size clinkers that gradually move to the bottom of the fuel bed and accumulate on the grate 270.

With reference to FIGS. 2 and 13, the furnace arch 320 is a refractory radiation shield supported by inverted "T" boiling water circulation tubes 105, with a circular opening 147 for flue gas passage. The arch creates a furnace cavity trapping thermal radiation from the fuel bed to improve combustion and fuel bed temperature uniformity, and increasing heat transfer to water in the furnace walls for raising steam.

Below the arch, combustion gases move in a cyclonic pattern which continues through the arch opening into the upper furnace space 103 above the arch. This space is a convective heat transfer and transition region where gases enter the back tube sheet 322 and firetubes 324.

With reference to FIGS. 13 and 14 water circulators 105 are provided in the fire box. Each circulator is in the form of an inverted "T", with three connections to the water space: one at the crown sheet and two to the side water walls. The circulators support the refractory arch 320 over the fire bed and provide natural water circulation around the fire box 132. Even in low water conditions circulator action brings water from the side walls 670 to the top crown sheet 674, flooding the crown 676. The circulator nearest the firetubes has a small exit deflector which floods water forward over the highest part of the crown sheet to the backs of the flues.

The fire box is constructed steel conforming to ASME and FRA thickness requirements. It consists of a crown sheet 674, two inner firebox side sheets 682, a back sheet 686 with fire hole 688, and the back tube sheet 322 which forms the front of the fire box 132. The back tube sheet becomes a throat sheet below the forward end of the furnace arch 320. The back sheet, crown sheet, and side sheets are supported by stay bolts 691 to the wrapper sheet 694 and 698 of the boiler. The wrapper sheet, which comprises the side water walls 694 and as well as the roof sheet 698, and the fire box 132 are constructed in the Belpaire form which gives reduced thermal stresses compared to conventional fire boxes. Stay bolt spacing conforms to ASME and FRA rules for the required boiler pressure. The highest part of the crown sheet near the back tube sheet 322 is equipped with a fusible plug which will melt under low water conditions allowing water from the forward circulator 105 to flood the furnace space 132.

The conventional mud ring of a locomotive furnace is replaced with a steel weldment 702 and refractory material 704, as shown in FIGS. 13 and 14. This design eliminates the need for a large casting for the mud ring. A manifold 706 in the ring 702 and is connected to wash-out connections 708, shown in FIG. 6, by suitable hoses or tubing (not shown) to clean ring 702 of any sediments or loose deposits.

Ash is transported by steam jet from the rear ash pan 331 up to the ash cyclone separator 143 and into the ash package 332. The cyclone separator in the top of the ash package allows ash separation without release of fugitive dust into the atmosphere. The ash package is equipped for cleaning by means of washout plugs 800 on each side of the box or by bottom doors (not shown) which can be opened when the box is lifted from the locomotive.

Dry ash and ash agglomerates gradually move to the bottom of the fuel bed 290 as coal particles shrink and burn out, and accumulate on the grate. The shuffling motion of alternate grate bars 270 slowly moves bottom material in the fuel bed toward the rear of the furnace where it passes beneath a grate bar and falls into the rear ash pan 331 for temporary storage.

As stated before, the boiler design is a Belpaire construction with welded stay bolts 691 and seams. Welded stay bolts eliminate maintenance problems associated with threaded stay bolts and give adequate flexibility to absorb thermal expansions. The Belpaire configuration gives maximum steam space, simplified construction and configuration of stay bolts, and maximum resistance to thermal stress as compared to conventional locomotive boilers. The boiler is equipped with a top-located manhole 802 for access to the firetube region.

Boiler insulation 804 is provided by a 2-inch layer of fiberglass or other insulating material.

Furnace firetubes 324 are nominally 3.5-inch outside diameter, arranged in triangular array on 4-inch center-to-center spacing. There is approximately 1000 $ft^2$ of firetube surface area for heat transfer to boiler water for raising steam. Each firetube contains one loop of superheater tubing 140.

The boiler is equipped with conventional railway-type safety valves 291 set according to FRA rules to relieve pressure above 300 psi. For clearance, the safety valves are mounted on each side of the boiler roof sheet 698 with a self draining tube 806 extending into the steam space over the crown sheet. Four safety valves 291 are included for redundancy.

The blackhead 808 of the boiler is equipped with standard pressure gauge, water level gauge glass and water gauge cocks. These instruments can be checked by inspection from the auxiliary compartment 544 and compared to remote readings in the locomotive cab 11. p Make-up water and boiler water are treated in accordance with customary boiler practice. The effect of the water treatment and the condensing steam cycle is to radically reduce boiler maintenance compared to known locomotive practices. Corrosion and sedimentation are minimal and scale no longer forms. The combination of all-welded construction and treated boiler water results in a minimum of maintenance required at firetube ends, circulator ends, stay bolts, and mud ring area.

A small amount of blowdown is provided from the mud ring region, which is conveyed back to water storage or blown to the field. Design blowdown is approximately 333 lb./hr. The blowdown prevents sediment accumulation in the mud ring.

The flue gas plenum 151 includes a mixing space 812 where flue gas flow recombines after having passed through the multiplicity of firetubes. It also includes space for the economizer 128, feedwater heater 124, multicyclone inlet 814, and ID fans 152. The mixing space also contains the superheater inlet and outlet headers 144 and 141, and all superheater tubes 140 that enter and return from the firetubes.

The economizer 128 is a compact, modular heat exchanger, externally finned to increase effective area on the flue gas side. It heats feedwater close to saturation temperature before it enters the boiler. The economizer can be removed as a single assembly for maintenance and repair, and for access to superheater assemblies and multicyclone dust collectors 326.

A drum-like enclosed feedwater heater 124 is in the plenum chamber 151. Feedwater circulation through the feedwater heater comes from the primary feedwater pump 66 with discharge to a water inlet check valve at the side of the boiler. The feedwater is heated by steam extracted from Weiss port 180 in high pressure steam cylinder 88. Condensed steam is conveyed back to the water tank 52 in the support unit 14.

Flue gas leaving the economizer passes through a battery of cyclonic dust collectors 326 for gas clean-up.

Cyclone collection efficiency is a function of gas flow rate through the cyclone 326. A battery of multicyclone collectors is employed such that at lower gas flow rates, the number of cyclone collectors in the gas stream can be reduced to insure that individual collectors are always operating with high efficiency regardless of total gas flow and locomotive power level.

Individual cyclones in the multicyclone battery discharge solids into the collection hopper or separator 328. Hopper volume is large enough so that clean-out will never be required more frequently than fuel pack replacement, and for most coals, will be required less frequently. Clean-out may be accomplished by any well known method, such as gravity drain, vacuum flush, or water washout; or the fly ash can be conveyed by air or steam jets through a tube to the ash box 332.

The furnace draft is provided by the induced draft (ID) fan 152. In a preferred embodiment, the ID fan consists of two identical squirrel-cage blowers 152 mounted on a common shaft 150 and driven by a single-stage steam turbine 148 in the main steam line between superheater outlet header 141 and main steam throttle 158. ID fan speed is nominally self-regulated in proportion to main steam flow rate. A steam bypass (not shown) may be provided to accomplish trim control on ID fan speed and furnace draft. Fan exhaust is directed vertically to the atmosphere as indicated by line 149.

Saturated steam from the water/steam space 135 at the top of the boiler flows through four steam inlet pipes 820 into the large central dry pipe 138 that conveys the steam to the superheater header 139 mounted at the front tube sheet 157. The steam passes through the double pass superheater 140, to the ID fan turbine 152, via conduit 156 to the pair of Wagoner throttles 158 on top of the valve chests of each high pressure cylinder 88 for accurate control of steam flow at the last instant before steam passes through the high pressure piston valves 163. Main steam passes through the piston valves and into the high pressure cylinders 88 where it acts on the pistons 400.

Steam exhausted from the high pressure cylinder 88 passes from the ends of the high pressure valve chest 161 to the receiver pipe 162. There is one receiver on each side of the power unit 12 joining each high pressure cylinder 88 with one of the low pressure cylinders 166. Crossovers 822 join the receivers and cylinder chests on both sides of the power unit.

An oil separator 824 is provided in each receiver 162 to remove any small quantities of lubricating oil before the steam passes to the low pressure cylinder valve chest. Oil removed by the separator is injected into the fire bed so that no servicing of the oil separator is required.

With reference to FIG. 22, each high pressure cylinder valve chest 161 contains a piston valve 163, 15 inches in diameter with 9-inch maximum travel. All steam ports are of maximum available flow area to insure the lowest resistance to high volume steam flow. The valve chest 161 has inside admission with exhaust ports 160 and with Weiss ports 182 at each end to equalize pressure at the ends of valve stroke. The valve is designed to be of light weight. In each valve a tubular hollow spindle 830 is driven by a suspended linkage 833. Within the spindle is mounted drive rod 835 by pivot pin 837. A damper 850 at one end eliminates longitudinal vibrations. The valve rings 858, 860' and the packing 859 are of the same type as used in the low pressure cylinder for optimal lubrication control, and the valve moves inside a removable liner 600, similar to the liner in the low pressure cylinder 166. The valve and valve chest are designed for ease of disassembly for maintenance.

With reference to FIGS. 21-25, receiver steam feeds each low pressure cylinder valve chest 201 via inlet ports 164. Because of the large steam volume, each chest contains two outside admission valves 165 which are driven as a pair. Each valve is 15 inches in diameter with a 9 inch maximum travel, and similar in construction to the high pressure cylinder valves 160. In each valve, a tubular hollow spindle 820 is driven by a suspended linkage 832 within the spindle is mounted drive rod 834 by pivot pin 836. The drive rod 834 can be displaced from longitudinal alignment with the valve spindle. (This same spindle and rod arrangement may also be applied to the high pressure cylinder valve.)

Located below the valve chest 201 is of the low pressure cylinder 166. The low pressure cylinder has a generally hollow cylindrical configuration within which the piston 402 and its integral piston rod 846 travel. The piston rod 846 is disposed for longitudinal movement within the cylinder portion. The piston rod emerges from both ends 850 and 852 of one cylinder portion. At the end 852 there is located an extension cap 854 which receives the piston rod on its return stroke, because the piston rod is of the extended type.

At each of the cylinder ends 850 and 852 there are a series of conventional packing rings 860 along with conventional packing material 861. A similar packing arrangement is provided for the valve rod 834 and is generally designated as 860' at each end of the valve chest as shown in FIG. 23. At one end of the valve chest there is provided a fluid dampening piston 862 which is secured to the spindle tube 828 by a pivot pin 864. The packing arrangement, for both the valve chest and the cylinder portion, through the use of a plurality of packing rings, provides a superior seal against steam leakage.

The interior 842 of the cylinder portion contains a cylindrical liner 601, made of a material known for its resistance to frictional wear, such as high grade steel. In turn, the peripheral portion 603 of the piston 402 contains a series of rings 605 made of a softer material to provide superior gliding of the piston along the liner 601.

Lubrication is radically different than in standard steam practice. Lubricant is delivered to the rings, cylinder and valve chest walls as in diesel engine practice.

As noted before, the mechanical descriptions of the high and low pressure cylinders are similar except that the low pressure piston is larger in diameter. The low pressure piston carries a clearance skirt 611 so that piston clearance volume is minimized yet a large port opening can be provided.

The low pressure cylinder is surrounded with a steam jacket 613, as indicated in FIG. 23, which reduces heat loss and provides thermal insulation.

The combination of two-stage compound expansion, insulation around all steam passages, piping, valve chest, the cylinders and steam jacketing reduces thermal losses in the steam power cycle.

Another oil seperator 401 is provided in the steam passages from the low pressure valve chest exhaust to the exhaust steam turbines to remove oil and lubricant before steam is passed to the eductor condensers and water coolers.

Steam exhausting from low pressure cylinders 166 is most advantageously at less than atmospheric pressure (partial vacuum) which improves engine efficiency through reduced back pressure. The partial vacuum is maintained by a combination of steam condensation and pump suction, which will be discussed in greater detail hereinafter. The better the vacuum, the more work that is potentially available in the expansion cycle. However, at very low back pressures, the specific volume of steam is quite large which requires large exhaust steam pipe dimensions. This is a serious practical limitation. Thus, there is additional expansion energy in the steam, equivalent to several hundred horsepower, which is not available in the steam engine expansion cycle, but could be harnessed by other means.

In a preferred embodiment, low pressure cylinder exhaust pressure is approximately 7 psi (about one-half an atmosphere, absolute) which is the practical lower limit to cylinder exhaust pressure. Exhaust steam is then expanded further, immediately upon leaving the cylinder 166, to a pressure of approximately 3 psi in the exhaust steam turbine 172 which, in turn, exhausts directly into the eductor condenser 86 to reduce its specific volume and eliminate the need for large steam pipe diameters to conduct low pressure steam to condensing coils 110. Thus, the low pressure cylinders 166 are operated in the most practical and efficient manner, and useful energy is also extracted from exhaust steam which would otherwise be lost. The energy from the exhaust steam turbine 172 is used to drive the balance-of plant equipment (water circulation pumps 80 and 96, and the main boiler feedpump 66 roots air turbulator/-blower 312 and primary generator 532.

There are two exhaust steam turbines 172, one at each low pressure cylinder exhaust 168, arranged to drive a common, lateral shaft 176 for power take-off. Turbine exhaust steam is directly entrained by a pair of eductor condensers 86 which share a common steam enclosure with each exhaust steam turbine.

Exhaust steam from each exhaust steam turbine is desirably close to saturation at a partial pressure of approximately 3 psia. To maintain such conditions requires condensation, vacuum pumping, or a combination of both. The eductor condenser 86, whose performance is well-known, performs both functions. Steam is condensed by mixing with sub-cooled water taken from the water tank 52 of the support unit 14. The mixing occurs by eductor action, whereby the steam is entrained in a forceful jet of sub-cooled circulating water whose high velocity serves to maintain the vacuum back pressure on the steam. The required mass flow of circulating water is approximately 40 times greater than the mass flow of entrained steam to adequately condense the steam. Even though the circulating flow rate of water from the support unit to the condenser 110 and return is so much greater than net steam flow, the great reduction in specific volume of the fluid makes the process an advantageous alternative for the condensing cycle.

In the event of failure of any one of the exhaust steam turbine 172, condenser 86, support unit cooler 42, or in the case of extremely hot and unusual environmental conditions (air temperature greater than 110° F.), such that partial vacuum back pressure can no longer be maintained, an emergency free exhaust port 403 leading upward to the atmosphere from the condenser enclosure can be opened permitting non-condensed steam to escape from the eductor condensers 86. This could enable continuous locomotive operation, possible at severely derated horsepower depending on extent of locomotive system failures, until water storage is depleted.

With reference to FIGS. 2 and 4, water circulation pump 96 is a gear pump, although other pump types are contemplated. The pump draws suction from the exhaust of condenser 86, and helps maintain vacuum back pressure at the exhaust steam turbine outlet 171 and low pressure cylinder exhaust port 168.

It is driven by direct coupling to the exhaust steam turbine shaft 176 via speed reduction gear 178, and its pumping rate is nominally self-regulating in proportion to steam flow. At full locomotive power, mass flow rate of circulating water is approximately $1.3\times10^6$ lb/hr.

The pump 96 delivers high pressure water to the support unit 14 which drives cooling fans 116 and the coal stoker motor 104 with water turbines. The circulating water then passes through cooling tubes 110 and returns to water storage tank 52.

With reference to FIGS. 31–33, the interconnections between the power unit 12 and the support unit 14 are shown. With regard to FIG. 33, the right-side end of the support unit is shown with the various interconnections.

As oriented in FIG. 33, in the lower left hand corner of the support unit there are two flexible hoses 502 and 504. Hose 502 is connected by a quick disconnect with a similar hose 502' on the power unit and conveys water from the water tank in the support unit to the feedwater pump 66 via the suction booster injector 60 both of which are contained on the power unit. Hose 504 is interconnected by a quick disconnect with a similar hose 504' on the power unit and provides an auxiliary connection to conduct water from the water tank 52 on the support unit to an auxiliary feed water pump 540 should one be employed in the system.

Located above hoses 502 and 504 in the lower left hand portion of the wall of the support unit, is an 8 inch flexible hose 506 which mates, by flange connection, with a similar hose 506' on the power unit and acts to convey water from the eductor condenser 86 located on the power unit to the water tank located on the support unit.

Located at the lower right hand portion of the wall of the support unit is another 8 inch hose 508 which mates, by flange connection, with a complimentary hose 508' on the support unit and conveys water from the water tank 52 on the support unit to the eductor 86 on the power unit.

Centrally located in the lower portion of the wall of the support unit is the stoker screw 130 which through a suitable coupling 121 is connected to a complimentary structure 130' on the power unit. Below the stoker screw is the draw bar 18 and safety bar slot 16. Located below this structure is the buffer 411.

Located to the left of the draw bar and slightly below the stoker screw are series of hoses generally designated as 510. One of these hoses 512, by flange connection, mates with a similar hose 512' on the power unit to provide steam from the power unit to an auxiliary stoker engine, should one be employed in the support unit. A second hose 514 by Cannon plug connection or equivalent mates with a similar hose 514' in the power unit and contains all wiring to provide an electrical interconnection should the locomotive system 10 be employed in a multiple unit operation. The remaining four hoses 516 with glad hand connectors are air hoses used in a multiple unit interconnection.

To the right of the draw bar slightly below the stoker screw is a set of hoses generally designated as 520. One of these hoses 522 by quick disconnect is interconnected with a similar hose 522' on the support unit to provide steam from the low pressure cylinders 166 to the coal draw on the support unit in the form of coal wetting steam 228. A second hose 524 by glad hand connection provides yet another interconnection with the power unit for operation of the air brakes on the support unit. The remaining four hoses 526 with glad hand connections are air hoses which are used for multiple unit operation in a manner similar to hoses 516.

Flexible pipe connections eliminate right angle ball joint connections which would interfere with high volume recirculating water flow rates.

With reference to FIG. 35, the locomotive 10 has a four cylinder 88, 166 opposed piston engine. Each pair of pistons 400, 402 on each side of the power unit 12 are in dynamic opposition, 180 degrees out of phase.

Inside coupling rods 481, arranged on crank axles 483, keep the pistons in dynamic opposition. They normally transmit only the difference in thrust between the high pressure pistons 400 and the low pressure pistons 402, except during wheel slip. Therefore, average loading in service on these coupling rods will be small, but they must be designed, nonetheless, to absorb temporary high thrusts when a portion of the drive unit loses adhesion.

Crank axles 483 for the coupling rods are set at 90 degrees. This insures even distribution of force through the coupling rods and axles under all conditions.

The crank axles 483 can be built up as shown in FIGS. 26 and 27, or can be one piece forgings. If built up using a shaft 485 and a web 487 as shown, crank counter weights 489 can be provided in the crank axle web 487. But the crank axle must be disassembled to replace coupling rod bearings 491. If crank axles are one piece forgings, however, then better accessibility can be provided to coupling rod bearings, but any coupling rod counter weights must be placed in the main drive wheels.

In a conventional steam locomotive, counterweights on drive wheels must balance not only the revolving weights attached to the drive wheels, but also the effects of reciprocating mass. Additional counter balance mass is placed in wheel counterweights to give some dynamic opposition to longitudinal and oscillating piston thrusts. This so called excess mass causes drive wheels to be out-of-balance in rotation. At high RPM, the inbalance condition can severely damage rails due to excessive oscillating vertical pressure. If excess mass is reduced, unbalanced reciprocating piston forces will cause the locomotive to oscillate laterally and also damage the track. Conventional balancing practice was, at best, a compromise.

With regard to a preferred embodiment of the driving gear layout shown in FIG. 35, the opposed piston pairs 400, 402 on each side of the locomotive result in nearly perfect reciprocating balance. The smaller high pressure piston 400 can be provided with additional weight to equal the weight of the low pressure piston 402, if necessary. With such an arrangement, driving wheel counterweights 981 serve only to balance revolving masses attached to the wheels. Side rods 493 connected to drive wheels can be perfectly balanced using conventional cross balance techniques. Main connecting rods 495 can be balanced by the center of percussion technique to find the equivalent revolving mass.

In the locomotive, according to the teachings of the present invention, it is practical to achieve near-perfect rotary balance in all planes of each drive wheel pair. The total effect on the rail of unsprung weight and the rotary characteristics of each drive wheel is similar to a passenger car, and more favorable than a standard diesel locomotive driving axle with assymmetrically suspended traction motor.

The key advantages of the balanced drive system are as follows:

(1) The four cylinder layout allows for easy application of compound steam expansion.

(2) All cylinders, crossheads 497 and main connecting rods are easily accessible for service and maintenance. Pistons and associated running gear machinery can be easily removed without full disassembly of the entire running gear system.

(3) All bearings in the running gear system are either spherical roller bearings or tapered roller bearings. Locomotive speed is limited only by the centrifugal forces which these roller bearings can take. This drive gear system can run at much higher speeds than conventional steam locomotive running gears.

(4) Piston thrust is divided among four cylinders instead of two. Stress on crossheads, pins (such as main pin 983), rods and so forth are reduced by two, compared to an equivalent 2 cylinder engine.

(5) Because of the inherent balance and higher dynamic speed capability, the drive system can use smaller drive wheels than would normally be acceptable. Smaller drive wheels permit better pulling characteristics at low speed, while the balance characteristics allow the drive to run at the highest permissible track speeds without stressing running gear or track excessively.

(6) Inside coupling rods insure synchronization. These rods need absorb only the difference between piston thrust at each end of the engine. Therefore, the coupling rod bearings 491 can be over-designed and sealed, requiring maintenance only when main drive wheel axle bearings are maintained.

(7) The first axle 561 and fourth axles 563 in the driving gear are equipped with conventional lateral motion restoring and cushioning devices 565. This shortens the effective rigid wheel base to approximately 6'-6", that is the distance between the second and third driving axle centerlines. This short rigid wheel base combined with lateral motion of the first and last driving wheels provides for a driving gear which can easily negotiate sharp curves and remain laterally stable at high speeds.

All axles and rods equipped with roller bearings. Adequate lubricant space is provided in all bearings to give an extended time between servicing. Tapered roller bearings are applied to all axles 569; spherical roller bearings 567 are applied to all side rods, connecting rods and coupling rods.

With reference to FIG. 2, the spring rigging system 571 follows conventional practice, using overhung equalizers 573 with underhung springs 575 in a continuous spring and equalization system running from the front to the back of the locomotive. Each end of each spring system tying the springs of several wheels together are equipped with coil spings 577 so that the connection between spring systems and frame is not entirely rigid. Spring and damping characteristics should be carefully chosen to insure longitudinal and lateral locomotive stability at all operating speeds.

Locomotive equalization and spring rigging follow the standard "tripod theory". The front leg of the tripod consists of the four wheel engine truck 32 riding on its lateral bolster 581. Each of the other two tripod legs consist of four driving wheels 34 and one wheel of the trailing radial truck 31 equalized together down each side of the locomotive. The equalization system continues through all four driving wheels on a side and connects to a wheel of the radial truck on the same side. FIG. 2 shows the equalization connection between driving wheels and radial truck. No cross equalization is provided; each side forms an independent equalized suspension system. With the locomotive's suspension resolvable into a single tripod, wheel loadings on each drive wheel remain constant despite vertical pitching or oscillation of the locomotive. The constant wheel loading insures good adhesion and traction under all conditions.

The engine leading truck 32 is designed with conventional, lateral moving, self-centering geometry which will be provided with either gravity or spring centering with increasing or constant resistance under lateral deflection. The design of the four wheel truck and its incorporation into the running gear layout follows conventional practice which insures full stability and low flange loadings for the locomotive when running on straight track or entering curves at various speeds.

The radial truck 31 is equipped with a centering device 583 with only slightly increasing or constant lateral resistance. When the locomotive is running with the support unit forward, the radial truck provides horizontal guidance to the locomotive and eases flange loadings when entering curves. Lateral resistance is designed to complement lateral resistance of the four wheel engine truck.

Brake rigging follows conventional practice with two shoes 591 per wheel on most wheels in both power unit 12 and support unit 14. The driving wheel brake system is shown most clearly in FIG. 6 and consists on each side of three pairs of brake shoes. Each pair of brake shoes is opposed and equalized by a lever arrangement 593. This arrangement provides two shoes per wheel on the second and third driving axles. The lever arrangement consists of two vertical links 595, each fixed at one end to the frame by pivot 597. The other ends pivotally receive cross-link 599. A brake shoe 591 is secured to each vertical link. The air brake cylinder immediately under the air heaters provides brake action for three pairs of driving wheels and an air brake cylinder mounted over the radial truck provides the brake action for the pair of driving wheels under the fire box.

With reference to FIGS. 19 and 20, the frame is a standard bar type with transverse pedestal ties 951 to close the frame underneath the driving wheel axles. This frame is constructed entirely as a weldment with incorporation of cast steel in key parts such as coupler pockets, frame ties, and cylinder supports. Jacking beams 953 are incorporated at each end of the frame to allow easy jacking of the entire locomotive to service or remove running gear parts. Jacking beams eliminate the need for a large overhead shop crane, and to allow the locomotive to receive heavy service in existing diesel locomotive shops.

The drawbar 18 and safety bar 16 between the power unit 12 and support unit 14 are shown in FIGS. 2 and 6. The drawbar is made as long as possible to improve vehicle dynamics when running with the support unit forward. With the long drawbar and wide radius buffers 411, pushing action from the power unit to the support unit occurs on a centerline which is as close as possible to the track centerline in curves to minimize lateral pushout.

As shown in FIG. 34, each of the buffers 411 contains a radial buffer face 413 in the form of a gently curved face generally normal to the plane defined by a pair of railroad tracks 415. The radial buffers between the power unit and the support unit complement the drawbar. The radial buffer design prevents longitudinal slack, and provides favorable pushing characteristics at all operating speeds.

The exhaust steam turbine 172 drives the reduction gear 178 as shown in FIG. 4, and this reduction gear drives the main power shaft 180. Because the turbine speed is nominally self-regulated in proportion to steam flow, power delivered to machinery coupled to the power shaft is nominally proportional to locomotive power output. The power shaft 180 is divided into two sections 417, 419 with universal coupling 421, and is supported by three conventional roller bearings 423.

As shown in FIG. 4, the feedwater pump 66 is mounted on the right side of the power shaft 180. It draws water from the storage tank 52 in the support unit and delivers it first to the feedwater heater 124 and then to the economizer 128 mounted ahead of the front tube sheet 157. The pump 66 is centrifugal with sufficient capacity to provide 150 percent of nominal water flow required at full power.

Water circulation pump 80 is mounted on the left side of the power shaft 180 and delivers water from the water tank 52 on the support unit to the twin eductor condensers 86. Nominal pump capacity is 2600 gpm at relatively low head.

Two V-belt groups 530 are used to drive the primary generator 532 and Roots air turbulator/blower 312 from the power shaft 180. The primary generator has windings to supply AC and DC power for all locomotive electric power requirements. The Roots turbulator/blower 312 provides high pressure air for injection into the furnace combustion chamber 132 to improve cyclonic circulation. Excess high pressure air is fed to the main air brake reservoir. The Roots air blower is equipped with a suitable filter 1021 to prevent the ingestion of dust.

Number two water circulation pump 96 consists of two gear pumps driven by the power shaft 180. Each gear pump draws suction from the eductor condenser 86 immediately above.

The auxiliary feedwater pump 540 provides water to the boiler when the primary feedwater pump 66 is not turning or is delivering less than the required volume flow. This pump is mounted on the left side of the boiler immediately in front of the air heaters 236, 240. It is a steam driven pump with two stages of steam expansion compounded and a single water stage, with all three pistons mounted on a common shaft. The auxiliary feed pump draws water from the support unit storage tank 52 for delivery to the feedwater heater 124 and economizer 128. Exhaust steam from the auxiliary feedwater pump passes through a small oil separator and then exhausts to the eductor condenser chamber or directly to the water storage tank 52.

Two standard Westinghouse-type compound air brake compressors 542 are mounted in the auxiliary compartment 544 on the backhead of the boiler. They pressurize the primary air brake reservoir. Stam exhaust from the air compressors passes through an oil separator (not shown) and is fed to each eductor condenser 86, or directly to the water storage tank 52.

An auxiliary steam driven generator 546 mounted at the back of the auxiliary compartment 544 provides electric power when the primary generator 532 is not turning. The auxiliary generator has windings to provide AC and DC power sufficient to provide for all electric requirements of the locomotive while standing, idling, or during startup of the furnace. The auxiliary generator exhaust passes through an oil separator to tank 52.

Standard sanding apparatus 633 (employing standard pneumatics, not shown) is provided to locomotive driving wheels as shown in FIG. 6. In addition, pre-sanding nozzles 635 are provided on engine and trailing trucks. When running with the power unit forward, the pre-sanding nozzle under the power unit cab 11 is activated; with the support unit forward, the pre-sanding nozzles at the radial truck are activated. Each puts a small amount of sand on the idle wheel that precedes the driving wheels. This increases effectiveness of sand to the drive wheels.

Battery compartments 618 are provided under each corner of the cabs of both the power unit and support unit. These four battery compartments on the locomotive provide heated space for battery storage including space for excess battery capacity. The batteries are readily accessible from the ground.

With reference to FIG. 12, the manner in which many of the system elements are controlled will be described.

The ID fan 152 is turned by the steam turbine 148 mounted on the same shaft 150. The steam is main steam, and the turbine is immediately down stream from the superheater outlet header 141. The system is inherently self-regulating. A turbine bypass valve 560 provides trim control in ID fan speed. Control of the turbine bypass valve 560 is based on deviation of flue gas flow rate from set point valve determined as a function of steam flow. Flue gas flow rate is determined by measuring pressure drop across the firetubes.

The self-regulating feature provides feedforward control action. Feedback control trims the turbine bypass valve on the basis of flue gas flow rate error (deviation from load dependent set point). Anticipatory control is provided by steam pressure error. For example, a sudden increase in steam flow (open throttle or longer cut-off) will cause a steam pressure drop. Quick response by the ID fan to increase draft will minimize the steam pressure drop.

The stoker motor 38 is powered by circulating cooler water whose flow rate is directly coupled to low pressure cylinder exhaust steam flow by the exhaust steam turbine 172. Stoker motor control in inherently self-regulating. Trim control is provided by a series throttling valve based on a function of main steam flow. Since coal feed is a relatively slow process, there is no need to respond to short term deviation of steam pressure from set point—only longer term changes.

The main boiler feed pump 66 is driven from the exhaust steam turbine 172. Feed pump control is inherently self-regulating. Trim control of the feedwater flow control valve may be based on a conventional 2-element level control sensing water level and steam flow.

Several control philosophies are possible for throttle and cut-off. In a preferred embodiment, the one selected initially is analogous to diesel locomotive control in that the engineer will manipulate a "locomotive throttle" with off, idle, and eight notch positions, where each notch corresponds to a target value of indicated locomotive horsepower. Control action is initiated by deviation of actual indicated horsepower from the targeted value, and this action results in manipulation of throttle valves and advancing cut-off to the high pressure and low pressure cylinders 88 and 166.

Cab controls are shown in FIGS. 3 and 4. The throttle lever 701 is a conventional diesel type throttle lever with 8 notch positions. This same throttle lever can provide a parallel signal to diesel locomotives in tandem to set the diesel throttles in the same notch position as the steam locomotive throttle lever. The reverse control handle 703 in the cab simply provides for forward, neutral and reverse direction of operation. A dynamic brake handle 705 is also provided at the operator control position with 8 notch positions, like a conventional dynamic brake. The dynamic brake handle in the cab can also provide a parallel signal to the dynamic brakes of diesel locomotives in tandem to set their dynamic brakes at a similar position.

In essence, under the principal of dynamic braking, the cylinders provide a retarding action against negative work while the locomotive and the train are proceeding downhill. The pistons work against the small amount of steam and the valve gear is set in a moderately reversed position.

Adhesion control can be divided conceptually into two functions. One is the prevention of slip in real time and the second is the maximumization of available adhesion by generating a controlled amount of slip in the drive wheels to maximize traction. Both functions of adhesion control are facilitated by locating the Wagoner type throttle 158 as close to the high pressure valve chest 161 as possible to reduce storage and transit delay times. Then the adjustment of cut-off and valve timing in the shortest possible reaction time is essential. Therefore, moving parts involved in changing valve cut-off and timing should be designed for minimum inertia. Positive control of the cylinder cocks (FIGS. 22B and 23B) can also prevent slips by venting excess cylinder pressure immediately if required.

As best illustrated in FIG. 6, the valve gear, generally shown as 461, is a standard Walschaert locomotive valve gear, equipped with needle and roller bearings throughout. Two options of valve gear cut-off controls may be provided. The first option (FIG. 24) uses a linkage 463 from a mechanically or electrically controlled servo 465 and air cylinder 467 to change valve cut-off timing. The second option (FIG. 25) uses electronic servo control 469 on the air cylinders 473 to control pistons 471 which change valve cut-off. This option minimizes physical mass and number of moving parts involved in changing valve cut-off position, and allows cut-off adjustments in the minimum possible time.

In both FIGS. 24 and 25, the valve gear basically comprises a low pressure cylinder valve rod 834 and a high pressure cylinder valve rod 835 each being pivotally connected to one end of a combination lever 351. The other end of the combination lever is pivotally connected to a union link 353, one end of which is movably secured to a crosshead 355. Pivotally connected to the combination lever is a radius rod 357, the free end of which is pivotally connected to a bell crank 359, in the case of the low pressure cylinder. Each of the main rods is pivotally connected to one end of an eccentric crank 361 which, in turn, is pivotally connected to an eccentric rod 363.

The end of each eccentric rod is pivotally connected to a link 365; in one case, the bell crank 359 rides in a space provided over the link 365. In the case of the radius rod associated with the high pressure cylinder, the end of that radius rod rides in the link 365. Also provided is an arcuate track or path 1001 within which the end 1002 of the combination lever 351 moves to provide a pendulum suspension.

In the embodiment shown in FIG. 24, one end of a reach rod 367 is pivotally connected to the free end of bell crank 359 and is pivotally mounted to one end of a second reach rod 369 by pivot 371 which rides in a fixed curved channel 373. The other end of reach rod 369 is pivotally connected to a third reach rod 375 at pivot point 377 to which is further connected yet another reach rod 379 that has its end connected to a stationary pivot point 381.

The free end of reach rod 375 is connected to one end of a bell crank 383 which has its other end connected to radius rod 357 on the high pressure side via reach rod 385. At pivot point 377, there is connected yet another reach rod 387 which is pivotally connected to the piston 465 of cylinder 46C.

The object of the reach rods and reach rod control cylinder is to make a vertical adjustment on the back end height of the radius rod. This height determines the length of the stroke of the valve. For a full stroke of the valve, which is referred to as full stroke, the radius rod has to be lifted to the extreme top or extreme bottom position in the link. Whether the rear end of the radius rod is lifted to the top or the bottom of the slide in the link, determines whether the engine proceeds forward or backward. If the end of the radius rod is further down in the link, the power unit would go in a forward direction, and if the rear end is all the way down in the link, then the power unit goes in a forward direction with the valve running at full cut-off for full stroke.

If the end of the radius rod goes down only a small amount from the center, then the power unit would still be going in the forward direction but the valve would only be moving a short travel or stroke, with a short cut-off. In symmetrical fashion, if the radius rod is lifted all the way to the top of the link, then the engine would proceed in reverse direction, but with full valve stroke, and then if the radius end of the rod were lifted up a slight amount, then the engine would go in reverse direction, but the valve would be moving with a short stroke.

Valve stroke setting is a key factor in controlling engine power. At a full valve stroke, steam is admitted to the cylinder during the entire piston stroke. At partial valve stroke, steam is admitted to the cylinder only during a portion of the piston stroke up to the so called "cut-off" point.

At full valve stroke the steam exerts maximum thrust against the piston for almost the entire piston stroke. However, the steam remaining in the cylinder after the stroke still contains energy that could have been utilized for expansion work, but is lost as the cylinder is exhausted in preparation for the next power stroke. At partial valve stroke more of the steam energy is utilized for expansion work, but the piston thrust decreases during the piston stroke.

An objective of locomotive control is to convert energy in the steam to draw bar horsepower most efficiently which often requires the shortest possible valve stroke to maximize steam expansion in the cylinders consistent with train speed and tractive effort requirements.

FIG. 24 is a mechanical way to achieve the required vertical adjustment in the back end of the radius rod. In a conventional system of adjusting rods and reach rods, all of the rods are usually static and only the radius rod, link eccentric rod, eccentric crank, and other rods connected to the crosshead are actually going to be moving back and forth in rhythm with the driving wheels. In the system of FIG. 24, the reach rods are set at some adjustment and, then, if power is needed from the engine, a control signal from the engineer would add some air pressure to the control cylinder which would then move the bell cranks to move the end of the radius rod to a different place in the link.

FIG. 25 illustrates another way of regulating the control cylinders, which change the position of the back end of the radius rod. It can be seen in the drawing that the amount of mechanical linkage has been reduced to an absolute minimum. Rather than having a mechanical linkage to make adjustment in the height of the back end of the radius rods, in FIG. 25, it is done with an air cylinder connected directly to the end of the radius rod. The adjustment cylinders are controlled by the servos which are connected directly to an electronic control in the cab.

By having all the reach rods and bell cranks eliminated, inertia is reduced to a minimum, and response time to effect a valve timing adjustment is reduced.

The locomotive is adaptable to either a standard air brake system as is currently produced in this country or could incorporate an electro pneumatic electronically controlled system. In the drawings, a standard Westinghouse #26-L brake system is incorporated in the locomotive because this is the most advanced brake system currently in use on American railroads. However, electronically controlled braking would be easily adaptable to the locomotive.

Figure 2B:
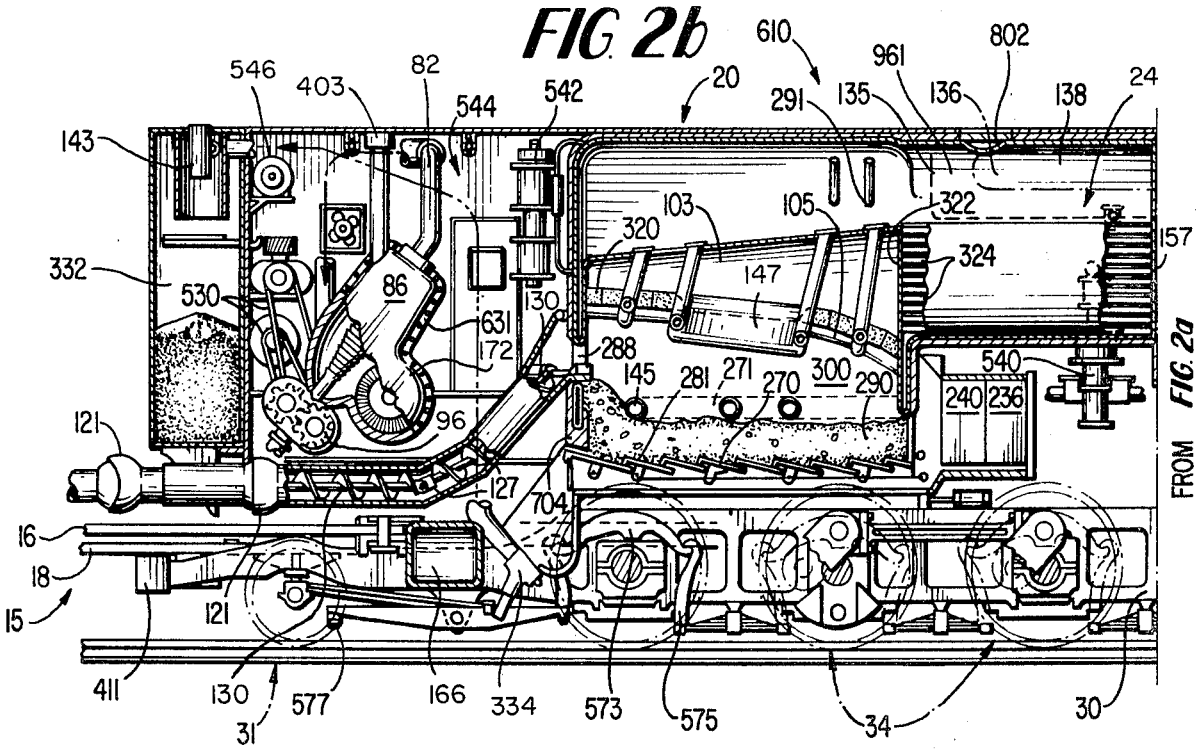

One air reservoir 961 is provided on the power unit on top of the boiler on the left side as shown in dotted lines on FIG. 2b. Two air reservoirs 963 are provided under the frame of the support unit, shown in FIG. 8. All three reservoirs are fed by the air brake compressors and the tanks are equipped with suitable drains which may be opened from ground level by a member of the crew.

Two seats 261 are provided in the cab to accommodate two locomotive crew members as currently required in most railway union agreements. However, the locomotive is designed to be operated entirely by the locomotive operator in the right hand seat. The person riding in the left hand seat serves simply as safety observer or the seat may be occupied by a conductor of the train and a suitable desk light is provided for this use. In addition to the two main seats, two additional folding jump seats 263 are provided on the back wall behind the doorways.

The cab design incorporates current safety features for crew protection in collisions with other trains or collisions with vehicles at grade crossings. Because the cab is short in length form front to back, the nose portion 501 is built of extremely strong structural members to absorb impact crash loadings. The collision shield 503 is a solid reinforced panel with no doors or hatch penetrating through it. The collision shield is angled in top plane view and the side view is angled in a slightly forward position to deflect objects which may be struck by the locomotive and prevent these objects from riding over and penetrating the cab. The lack of doors or hatches in the collision shield is designed to prevent flaming liquid or gasses from penetrating the cab during any serious crash. The windshield panel 505 is sloped backwards for deflection and also angled in planeview. Three intermediate posts 507 are provided in the windshield panel to help prevent penetration of objects into the cab and yet provide adequate windshield area for visability. Rollover structure 511, as U-shaped reinforcing members, is built into the side walls and roof of the cab to protect the crew if the locomotive turns over in a derailment.

The entire cab 11 is built as a structural unit for attachment at a minimum number of points to the locomotive frame. These attachments are necessarily strong to protect cab integrity in a collision but during ordinary servicing requiring access to areas obstructed by the cab the entire cab can be easily removed. The cab has its own floor structure 513 and all locomotive controls and electronic equipment are mounted to the cab except perhaps air brake control as discussed hereinafter. Therefore, release of the cab from the frame requires disconnection of electrical and physical connections. If a standard air brake system is used, the air brake stand is designed to stay with the locomotive when the cab is pulled off so that the air brake control stand cannot be disassembled to remove the cab.

As shown in FIGS. 6 and 7, all side and top panels 517 and 519 of the hood are designed to be removed in roof and wall sections. Ordinary daily servicing of the locomotive is facilitated by the panel construction 521 immediately above the driving wheels and cylinders. The bottom sections of the side panels are hinged at 523 to facilitate access to valve gear, lubricators, the throttles, air brakes, cylinders, grate, air duct grill and overhung brake rigging. Additional hatches are provided under the cab in both the power and support unit for air brake equipment, sand and batteries.

With reference to FIGS. 28–30, the four coal openings 372 in the bottom of the box 50 are designed to have the minimum area consistent with a good flow of the coal and yet allow the sides 392 to close when a box is not entirely empty. Each box is equipped with lifting eyes 531 for transloading by a crane and hinged doors at the top for loading. Several of the coal packs could be loaded on a modified flat car for the journey to and from the mine with the doors opened at the top of the box. The boxes can be loaded as conventional railway hopper cars. Rugged construction is provided throughout so that the box can withstand the abuse it will take in loading at the mine and transloading on board the locomotive. Ample interior 370 is provided, and all parts of the pack are kept as simple and direct as possible. The pack is designed to be a standardized pack which could be fitted on any locomotive.

The main stoker motor 38, as shown in FIG. 12, is a water turbine motor powered by return water going to the support unit cooling assemblies or towers 110. The main stoker turns the stoker screw shaft 123, which through its universal couplings, rotates through its entire length in both power unit and support unit from the single power source. If the main stoker motor jams, if turning the coal screw requires additional power or if water is not flowing to the main stoker motor, an auxiliary reciprocating stoker motor 533 has a virtue of a steam piston engine in that it can exert high torque at low rpm when there is temporary obstruction in the coal screw. The coal screw and auxiliary stoker motor are adapted directly from standard practice on steam locomotives.

The modular coal packs are shown in FIGS. 8, 11 and 28–31. The frame work beneath the pack is welded, and the structure serves as tracks for four steel plate doors 392 similar in construction to the sliding doors under a standard railway hopper car. The mechanism 396 to open the coal pack door is a permanent part of the power unit structure. The coal pack opening mechanism could be operated by power shafting or separate air motors could be provided to turn gears to engage teeth 1011 of the racks on the bottom of the floor sliding steel doors. In end view, the coal pack is designed to follow the clearance profile of the locomotive and the location of the coal pack in the support unit is designed to be non-critical. Each coal pack may contain a transverse strut member 1013 positioned near opening 372 to provide added reinforcement where the coal exits the coal pack.

The location of a coal pack, when set into the support unit could vary up to 2 inches and the door slides could still be operated adequately. The support unit contains a series of spaced support struts 1017, which mate with and support the coal packs. Access doors 1015 are provided in the support unit at the coal pack areas shown in FIG. 8 and the hatches provide access to the door retracting mechanism and manual locking pins 1016 which hold the coal packs in place on board the support unit. After coal packs are loaded on the locomotive by crane, the sliding doors can be pulled and the coal will spill into the trough of the coal screw in the support unit. When the coal pack is to be changed whether it is empty or partially full, the bottom doors must be closed. The door operating mechanism slides are designed to close the doors against a partial load of coal in the box.

The makeup water tank 52 of approximately 10,000 gallons capacity is provided in the support unit 14 as shown in FIGS. 8–11. FIG. 10 shows a cross-section of the water tank which forms the floor 271 under the water cooler assemblies and forms a tower 273 in the center of the support unit holding the water driven cooler fans 116. The water tank is equipped with suitable baffles and support structure to have structural integrity. The makeup water tank may be filled from ground level by a pressure water fill 275, one on each side of the locomotive as shown in FIG. 8, or the tank may be filled by gravity from the roof. The gravity water fill caps 277 also provide pressure relief when the pressure water fill is being used. Water supplied to the locomotive is to be treated water. If not, a small chemical plant should be provided on board the support unit. Sophisticated modern water treatment is required to minimize boiler maintenance and to prevent corrosion of the entire water cycle system.

The support unit frame is a weldment of standard design and structure such as that found in a conventional tender or diesel locomotive.

The support unit trucks 46 are adapted directly from standard high speed trucks which were used under steam locomotive tenders. These trucks are suspended entirely on coil springs, and are equipped with roller bearings on all twelve journals. Truck mounted brakes are provided with two shoes per wheel. The truck centers 279 are chosen to give approximately equal lateral displacement of the end of the support unit frame where the frame joins the power unit. This is illustrated in FIG. 34, where on the sharpest operating radius the overhang of both power unit and support unit at the rear corners is approximately equal.

The support unit cab 13 is identical in all respects to the power unit cab 11 and the locomotive can be operated equally well from either position and in either direction.

Although the present invention has been shown and described in terms of a preferred embodiment, it will be appreciated by those skilled in the art that changes or modifications are possible which do not depart from the inventive concepts described and taught herein. Such changes and modifications are deemed to fall within the purview of these inventive concepts.

For instance, an alternative embodiment 10', provided specifically for the purpose of increasing low speed tractive effort, shown in FIG. 36, where like reference numerals denote similar elements to the embodiment of FIG. 1. Since the majority of the elements are the same, only the differences will be described. The structure of the boiler 20 and accessories 24 and the machinery of the running gear 34 are identical in all respects to the first embodiment. Also, the cooling modules 42 and water storage area 40 and cooling fans 116 of the alternative embodiment are identical to the first embodiment. The alternative embodiment incorporates 8 driving axles 34 with four of these under the support unit 14 and four under the power unit 12. High pressure steam is divided in its passage to four high pressure cylinders 88 located as fore and aft pairs on either side of the centerline of the power unit and extraction steam from these high pressure cylinders fills a receiver 162 which then passes from the power unit to the support unit where the steam divides again and supplies inlet steam into the four low pressure cylinders 166 similarly located as fore and aft pairs on either side of the centerline of the support unit 14. In yet an additional embodiment of this same locomotive 10'N the cylinders could be arranged in like manner to locomotive 10 on each of the power and support units. In that additional embodiment, each unit would have two high pressure and two low pressure cylinders.

The machinery of the embodiment of FIG. 36, except for the layout of the cylinders 88, 166, is identical to the embodiment of FIG. 1 so that at the upper end of the speed range there is no difference in machinery limit of the two locomotives. For improved operating capability of the alternative embodiment in the higher speed range, poppet valves may be used because of the ability of poppet valves to have more precise control steam flow at necessarily short cut-offs.

Because the support unit of the alternative embodiment has driving gear 24 mounted beneath the frame 30, there is less vertical distance in the support unit to provide room for necessary equipment. There is not room for the same layout of condensing modules, water, and coal packs as found on the support unit of the first embodiment. Therefore the coal packs 50 are located on a separate articulated carrier 671 mounted between the power unit and support unit. This carrier has two conventional outside frame four-wheel trucks 673 and each truck is equalized by conventional means (as for example, the way in which a Southern Pacific AC-class steam locomotive had its outside-frame four wheel engine truck equalized with its adjacent driving group) into the driving gear 34 of the power drive immediately adjacent. Therefore, the weight carried by the coal pack carrier trucks is less affected by the amount of the coal carried in the packs, because, the coal pack carrier trucks 673 support a portion 675 of the power unit weight and a portion 677 of the support unit weight as well as the weight of the coal packs. The layout of driving gear and auxiliary wheels of the locomotive 10' provides for excellent tracking characteristics in both directions of operation.

Further, it is contemplated that the teachings of the present invention may be applied to steam turbine electric locomotives. FIG. 37 illustrates a preferred embodiment, where like reference numerals denote like elements of the embodiment of FIG. 1. For this reason only the differences will be described.

The locomotive, generally designated 10'', is designed to adapt the gas producer combustion system of the present invention to a steam turbine electric drive. To provide the increased pressure steam required for turbine operation, a gas producer adaptation is made to a standard form of water-tube firebox 325 with a firetube barrel. Operating pressure is 600 psi with final steam temperature approximately 900° F. The superheater 140, economizer 128, feedwater heater 124, multicyclones 326, ID fans 152 and support systems are adapted directly from the power unit of the embodiment of FIG. 1. The steam turbine electric transmission 681 located at the back of the power unit is adapted directly from known locomotive systems. Likewise, the turbine 685 is a known multi-stage axial turbine. One such turbine system was used on the Norfolk and Western #2300 locomotive in past practice. Eight driving axles are provided under the power unit by means of two standard Electromotive Cor. type DD trucks 683 with each truck carrying four standard EMC type traction motors controls and electrical gear follow conventional practice. The support unit (not shown) is identical in all respects to that of the embodiment of FIG. 1, except that the jet condensers 86 are relocated to the support unit in a space between the cooling area 42 and the coal pack area 36. Electric motors drive the circulating pumps associated with the jet condensers, with current supplied by the main generator driven by the steam turbine. Therefore, approximately 6 ft. of additional space is provided on the support unit for the eductor condensers.

The water-tube firebox with firetube barrel boiler provide steam sufficient to produce 4,500 shaft HP from the turbine. This power shaft HP is sufficient to provide 3900 to 4000 drawbar HP to the rail at speeds between 10 and 40 mph. The power unit is capable of exerting at least 140,000 lbs. of tractive effort continuously up to the limit of the boiler. A virtue of the electric drive is that the support unit axles may be provided with traction motors, and, if so, the low speed continuous tractive effort could be significantly increased by at least 15,000 lbs. of continuous tractive effort for each support unit axle provided with a traction motor.

The boiler 24 was described in the context of the embodiment of FIG. 1 and additional features in locomotive 10″ include two stages of superheating. One stage is a standard Type-E superheater at the front of the firetube barrel and the additional stage of superheater 687 is provided in the furnace combustion chamber 132 by conventional superheater loops from the main steam drums.

A standard Detroit CC shuffle grate is employed, except that the shuffle grate carries the ashes in the direction away from the stoker feed 130. Ashes are dumped directly by gravity into an ash box 332 under the locomotive frame. This ash box could be serviced by a forklift truck at servicing stops.

Fly ash is collected at the front of the locomotive in the same fashion as the embodiment of FIG. 1 and collected cinders are conveyed by steam or air back to a fly ash box 330 located under the locomotive frame next to the main ash box.

Some steam is tapped from the superheater header 133 to run the ID fan 152 and the steam is then passed back to run some of the auxiliaries. The main steam flow is from the superheater header back to the inlet of the axial turbine 695. The steam then flows out of the axial turbine to a flexible exhaust steam connection to the support unit into the twin eductor condensers 86 mounted on the support unit. All other aspects of the steam cycle are substantially identical to the embodiment of FIG. 1.

From the above, it is apparent that many modifications and variations of the present invention are possible in light of the above teachings. It is therefore to be understood that, within the scope of the appended claims, the invention may be practiced otherwise than as specifically described.

What is claimed is:

1. A locomotive comprising:

a water tank holding a quantity of water;

means for generating steam;

first conveying means for conveying said water from said tank to said steam generating means for conversion to steam;

steam engine means for converting said steam into a mechanical motion, said steam engine means releasing portions of said steam during said conversion;

second conveying means for conveying said steam from said steam generating means to said steam engine means;

means responsive to said mechanical motion produced by said steam engine means for causing said locomotive to move in a desired direction;

third conveying means for conveying water from said water tank;

steam conveying means for conveying said released steam from said steam engine;

condensing means, operative to receive water from said third conveying means and to receive said released steam from said steam conveying means, for condensing said released steam by intermingling said steam with said water from said water tank;

cooling means for cooling water passed therethrough;

fourth conveying means for conveying said water from said condensing means to said cooling means; and fifth conveying means for conveying said cooled water from said cooling means to said water tank.

2. The locomotive of claim 1, wherein said condensing means comprises eductor condensing means.

3. The locomotive of claim 1, wherein said cooling means comprises:

at least one heat-exchanging means through which said water from said first condensing means passes; and means for directing air from atmosphere through said heat-exchanging means to provide air for cooling the water passing through said heat-exchanging means.

4. The locomotive of claim 3, wherein said cooling means further comprises:

fan means for drawing said air from atmosphere through said heat-exchanging means.

5. The locomotive of claim 4, wherein said cooling means further comprises:

deflecting means, secured to said at least one heat exchanging means, for directing said air passing through said heat exchanging means towards said fan means.

6. The locomotive of claim 1, wherein said steam generating means comprises:

a gas producer furnace for producing flue gases from coal;

a firetube boiler for receiving said cooling water and said flue gases, wherein said flue gases convert said cooling water into steam.

7. The locomotive of claim 6, wherein said gas producer furnace comprises:

a furnace chamber having a bottom;

a moving grate positioned for oscillating movement on the bottom of said furnace chamber;

a wind box defined below said grate;

means for introducing a source of primary air into said wind box;

an injector positioned below the grate within said wind box;

means for conveying fuel onto said grate to define a fuel bed;

a first area defined in said furnace chamber wherein said coal burns in the primary air supplied under said grate to create products of a first stage of combustion;

a second area defined in said furnace chamber and located above said first area within which said products of a first stage of combustion are burned to completion to create said flue gases;

means for injecting steam into said second area for enhancing said combustion;

means for introducing secondary heated air into said second area for creating a cyclonic path for said flue gases; and means for moving said flue gases in said cyclonic path into said first tube means.

8. The locomotive of claim 7 further comprising an ash pan positioned below said moving grate for receiving particles of combustion;

cyclone separating means;

means for moving said particles of combustion from said ash pan to said cyclone separating means; and an ash package for receiving the particles of combustion from said cyclone separator.

9. The locomotive of claim 7 further comprising air turbulator means for introducing swilling air into said second area of said furnace chamber.

10. The locomotive of claim 7 further comprising an inlet air damper through which air enters into said furnace chamber;

first and second pre-heaters through which said air from said air damper passes, each of said pre-heaters adapted to utilize extraction steam to heat said air from said air damper; and means for dividing said heated air into a plurality of paths, including a first path which passes heated air into said wind box under said furnace grate, and a second path which passes air above said burning fuel bed in order to create said cyclonic path.

11. The locomotive of claim 6, wherein said furnace produces a flue gas containing particles of combustion, and wherein said steam generating means further comprises:

receiving means for receiving said flue gas with said particles of combustion from said firetube boiler;

separating means for separating said flue gas from said particles of combustion in said receiving means;

means connected to said separating means for releasing said separated flue gas to atmosphere; and means connected to said separating means for collecting and storing said particles of combustion for subsequent disposal.

12. The locomotive of claim 11, wherein said separating means comprises at least one cyclone separator.

13. The locomotive of claim 11, wherein said receiving means comprises a flue gas plenum.

14. The locomotive of claim 11, wherein said means for releasing said flue gas to atmosphere comprises a fan, and means for connecting said fan to an output of said at least one cyclone separator.

15. The locomotive of claim 14, wherein said means for releasing said flue gas to atmosphere further comprises a steam turbine for operating said fan, and means for conveying steam from said steam generating means to said turbine.

16. The locomotive of claim 11, wherein said means for collecting the particles of combustion is a fly ash receptacle.

17. The locomotive of claim 16, wherein said fly ash receptacle is removably mounted in said locomotive.

18. A locomotive comprising:

a water tank for holding a quantity of water;

furnace means for producing flue gas from coal, said flue gas containing particles of combustion;

steam producing means receiving said flue gas containing particles of combustion for producing steam;

means for conveying said flue gas containing particles of combustion to said steam producing means;

means for conveying said water from said water tank to said steam producing means;

cylinder means including at least one piston for converting said steam into a reciprocating mechanical motion of said piston, said cylinder means releasing portions of said steam during said conversion;

means for conveying said steam from said steam producing means to said cylinder means;

means connected to said piston and responsive to said reciprocating motion produced by said piston for causing said locomotive to move in a desired direction;

condensing means, receiving said released steam from said cylinder means, for converting said steam to water;

means conveying said released steam from said cylinder means to said condensing means;

cooling means connected to said condensing means to receive said water from said condensing means for cooling said water;

means connected to said cooling means for conveying said cooled water from said cooling means to said water tank;

means for receiving said flue gas containing particles of combustion from said steam producing means;

separating means for separating said flue gas from said particles of combustion in said receiving means;

means connected to said separating means for releasing said separated flue gas to atmosphere; and means connected to said separating means for collecting and storing said particles of combustion for subsequent disposal.

19. The locomotive of claim 18, wherein said steam producing means includes a firetube boiler for receiving said water from said water tank and said flue gases, wherein said flue gases convert said water into steam.

20. The locomotive of claim 18, wherein said condensing means comprises eductor condensing means.

21. The locomotive of claim 18, wherein said separating means comprises at least one cyclone separator.

22. The locomotive of claim 18, wherein said receiving means comprises a flue gas plenum.

23. The locomotive of claim 18, wherein said cooling means comprises:

at least one heat-exchanging means through which said water from said first condensing means passes; and means for directing air from atmosphere through said heat-exchanging means to provide air for cooling the water passing through said heat-exchanging means.

24. The locomotive of claim 23, wherein said cooling means further comprises:

fan means for drawing said air from atmosphere through said heat-exchanging means.

25. The locomotive of claim 24, wherein said cooling means further comprises:

deflecting means, secured to said at least one heat exchanging means, for directing said air passing through said heat exchanging means towards said fan means.

26. The locomotive of claim 18, wherein said means for releasing said flue gas to atmosphere comprises a fan, and means for connecting said fan to an output of said at least one cyclone separator.

27. The locomotive of claim 26, wherein said means for releasing said flue gas to atmosphere further comprises a steam turbine for operating said fan, and means for conveying steam from said steam producing means to said turbine.

* * * * *